US006182434B1

(12) United States Patent
Kubový et al.

(10) Patent No.: US 6,182,434 B1
(45) Date of Patent: Feb. 6, 2001

(54) SPINDLE SPINNING OR SPINDLE TWISTING METHOD AND OPERATING UNIT FOR CARRYING OUT THIS METHOD

(75) Inventors: Václav Kubový , Třebovská ; Petr Blažek, Smetanova; Stanislav Dídek, Na Pláni, all of (CZ)

(73) Assignee: Vyzkumny Ustav Bavlnarsky A.S. (CZ)

( * ) Notice: Under 35 U.S.C. 154(b), the term of this patent shall be extended for 0 days.

(21) Appl. No.: 09/125,554

(22) PCT Filed: Feb. 24, 1997

(86) PCT No.: PCT/CZ97/00009

§ 371 Date: Aug. 28, 1998

§ 102(e) Date: Aug. 28, 1998

(87) PCT Pub. No.: WO97/32065

PCT Pub. Date: Sep. 4, 1997

(30) Foreign Application Priority Data

Feb. 28, 1996 (CZ) ..... 596-96

(51) Int. Cl.[7] ..... D01H 7/66

(52) U.S. Cl. ..... 57/354; 57/66; 57/72; 57/74; 57/127; 57/355

(58) Field of Search ..... 57/74, 66, 127, 57/72, 354, 355

(56) References Cited

U.S. PATENT DOCUMENTS

| | | | | |
|---|---|---|---|---|
| 2,833,111 | | 5/1958 | Hadlich | 57/74 |
| 4,592,196 | * | 6/1986 | Wolf | 57/74 |
| 4,779,409 | * | 10/1988 | Marchiori et al. | 57/354 |
| 4,862,287 | | 8/1989 | Marchiori et al. | 57/354 |
| 4,959,953 | * | 10/1990 | Krawietz | 57/354 |
| 5,109,659 | | 5/1992 | Tsuzuki | 57/66 |
| 5,590,515 | * | 1/1997 | Boden | 57/264 |

FOREIGN PATENT DOCUMENTS

| | | | |
|---|---|---|---|
| 3140422 | | 4/1983 | (DE) . |
| 3400327 | | 7/1985 | (DE) . |
| 4103369 | | 9/1991 | (DE) . |
| 4033951 | * | 4/1992 | (DE) . |
| 306691 | * | 3/1989 | (EP) . |
| 485880 | * | 11/1991 | (EP) . |
| 0496114A | | 7/1992 | (EP) . |
| 2088907A | | 6/1982 | (GB) . |

* cited by examiner

*Primary Examiner*—William Stryjewski
(74) *Attorney, Agent, or Firm*—Smith, Gambrell & Russell, LLP

(57) ABSTRACT

The process is carried out on a spinning system that has a driven spindle (13) and a balloon limiter (14) concentric with it, driven in the same direction as the spindle (13) an provided with an inner work surface (44). For the purpose of reaching the high operating speed, the yarn (P) entrained by the work surface (44) and running toward the tube (23) on the spindle (13) is first always given by the centrifugal process the shape of a rotating, open loop (48), from which the yarn (P) is subsequently drawn off and coiled directly onto the tube (23). In this connection, this rotating, open loop (48) can be radially delimited by a rotating or stationary limit ring (28).

32 Claims, 10 Drawing Sheets

Figure 1:
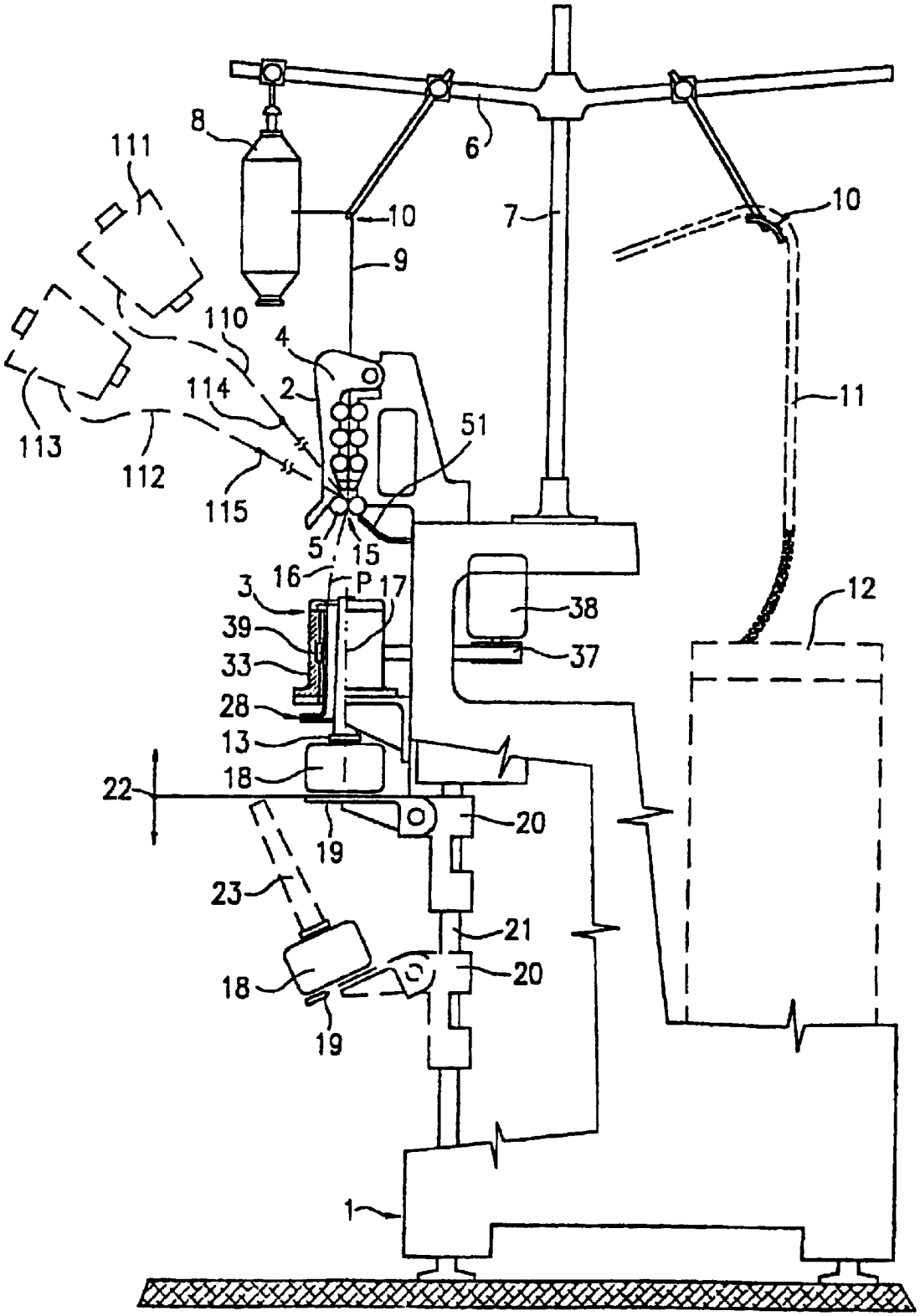

SPINDLE SPINNING OR SPINDLE TWISTING METHOD AND OPERATING UNIT FOR CARRYING OUT THIS METHOD

TECHNICAL DOMAIN

The invention relates to a spindle spinning or spindle twisting process that is carried out on a spinning system with a feed device for the fiber formation, with a driven spindle for the tube and with a balloon limiter arranged parallel with the spindle, also driven and having on its inner side a work surface for contact with the yarn, and a spinning system for execution of the process.

STATE OF THE ART

From U.S. Pat. No. 2,833,111 and in particular EP 0 496 114 A1 a spinning system is known in which a balloon limiter driven in the direction of the spindle's rotation serves as a support for the ring with the urchin or for another, equivalent means for carrying out a yarn force control before the yarn is coiled onto the tube.

The production speeds of such a spinning system are limited by a physical barrier that consists in that at extreme production speeds of spindles, the mass of the urchin or of another equivalent means causes a high degree of tensile stress that negatively influences the course of the spinning process as well as the practical characteristics of the yarn spun out. During operation there occurs at the same time a considerable urchin wear due to the contact with the fast running, extremely taught yarn. For this reason, it is necessary for the urchin to have been made of a very abrasion-resistant material and at the same time to be non-deformable for the purpose of overcoming the centrifugal forces in the yarn. These two conditions can only be fulfilled by using materials with greater density, resulting on the other hand in their greater specific mass. As was already mentioned, the urchin mass causes an undesired increase of stress in the yarn spun out, at constant rotational speeds of the balloon limiter rotating together with the urchin.

In another known spinning system of the type cited above (GB 2,088,907 A) the balloon limiter is formed by an actuated bell. In this case the yarn coming from a drafting arrangement runs inside the bell up to its lower edge. At this lower edge the yarn goes through a guide opening and is then coiled over this lower edge onto a tube. Thus, the yarn force control before the yarn is coiled onto the tube is carried out in this case by means of a lower bell edge. But because the yarn first runs through the guide opening from the inside of the bell out and then over the lower bell edge back against the tube, a large yarn loop is created between the yarn and the bell; this loop produces a considerable frictional resistance in such a way that it is neither possible to spin out several types of yarn nor to increase production speed.

DISCLOSURE OF THE INVENTION

The invention is based on the technical problem of creating a process of the type mentioned above and a spinning system for execution of the process, which reliably alleviates or eliminates all disadvantages stemming from the use of the known yarn force control before the yarn is coiled onto the tube and thereby makes possible the production of a high-quality ring spun or ring twisted yarn even at extremely high production speeds.

In so doing, the present invention features a process and a system in that the yarn entrained by the work surface of the balloon limiter goes directly from this work surface onto the tube as a rotating, open loop which stretches due to the action of the centrifugal force, in connection with which its reverse bending has a greater radial distance from the rotational axis of the spindle than that point on the work surface of the balloon limiter from which the yarn stretches into the rotating, open loop. In this process, a so-called yarn force control before yarn coiling onto the tube is carried out with the same yarn, namely by means of the rotating, open loop. In this case the advantage lies in the fact that no frictional resistances are caused that would limit the yarn in its faster movement to the tube, in such a way that the yarn coiling speed, that is, the spindle rotational speed, can be increased accordingly.

In a further design of the invention it is provided for that the rotating, open loop is radially limited during operation. Through radial limitations, the size of the rotating, open loop, that is, the distance of its reverse bending from the rotational axis of the spindle can be reduced, in such a way that the production of a quality yarn becomes possible even with relatively small space requirements.

In a further design of the invention it is provided for that the yarn forming the rotating, open loop is braked before coiling onto the tube; above all, this makes it possible to choose not only the different rotational speeds, but also corresponding rotational speeds of the spindle and the balloon limiter.

The spinning system for execution of the process contains a feed device for the fiber formation, a driven spindle for the tube and a balloon limiter arranged parallel with the spindle, also driven and having on its inner side a work surface for contact with the yarn.

According to the invention, in such a spinning system it is provided for that a peripheral stop for the transition of the yarn from this work surface directly onto the tube is arranged on the work surface, in connection with which the yarn is formed by the action of the centrifugal force in the form of a rotating, open loop, whereby any desired point on the work surface which is situated at a greater distance from the entry end of the balloon limiter than the cited peripheral stop is arranged at the greater radial distance from the rotational axis than this peripheral stop. This spinning system operates according to the process according to the invention, in connection with which all earlier limitations in the domain of so-called yarn force control before the yarn is coiled onto the tube are dispensed with. In this way, it becomes possible to produce various types of yarn that are at least as good as the so-called ring spun yarn and, in so doing, to achieve high production speeds.

The self-regulating spindle or twisting system according to the invention makes it possible to manufacture the high-quality ring spun yarn or high-quality twists at extremely high production speed. Useful designs and further developments of the object of the invention are indicated in the subclaims.

DESCRIPTION OF THE FIGURES IN THE DRAWINGS

Figure 2:
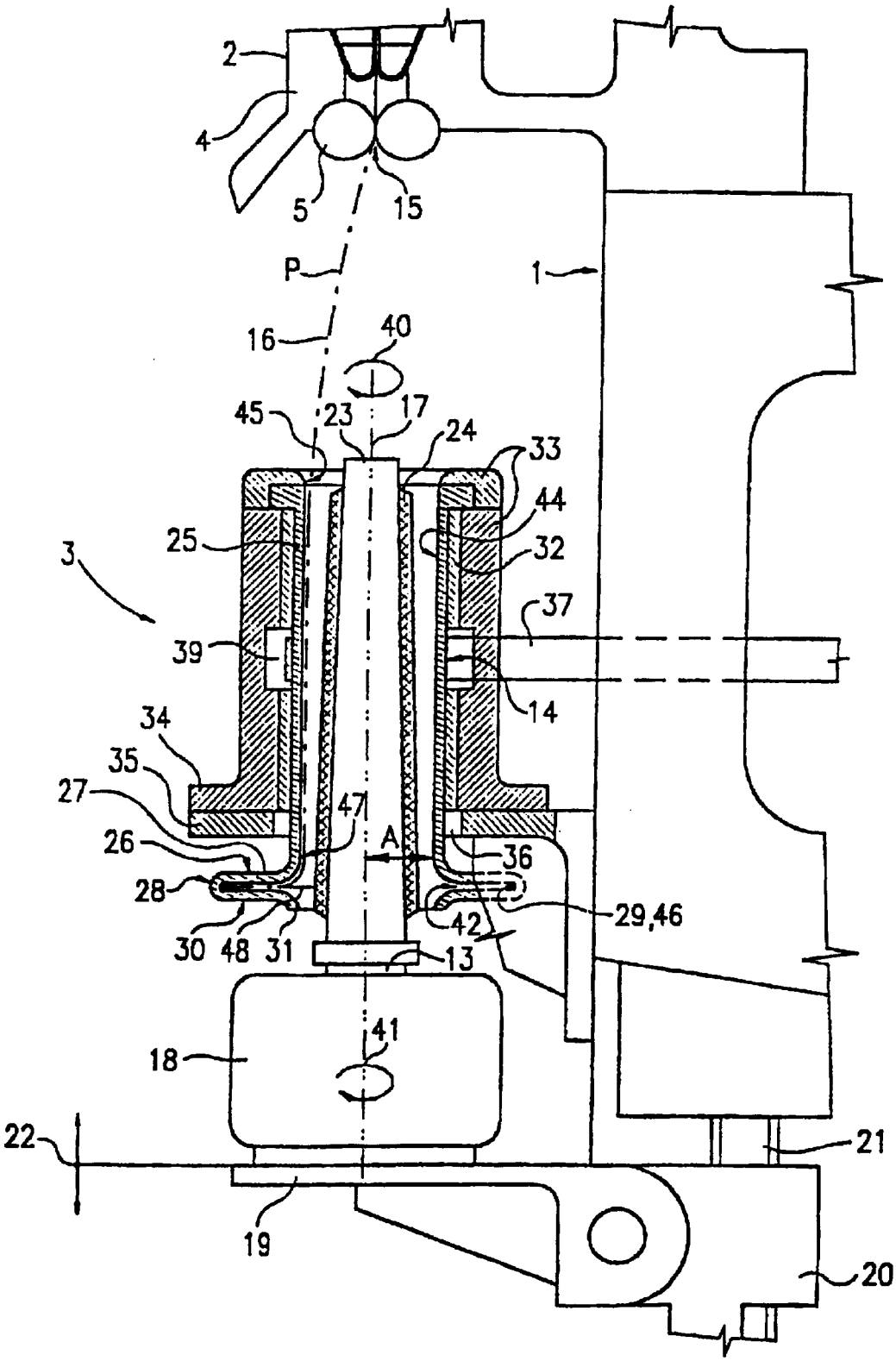
Figure 3:
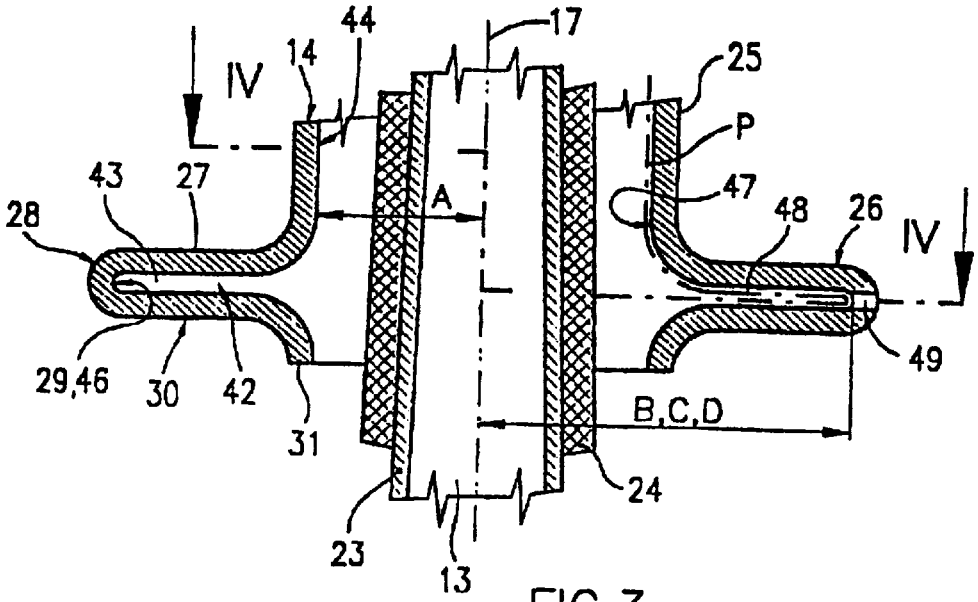
Figure 4:
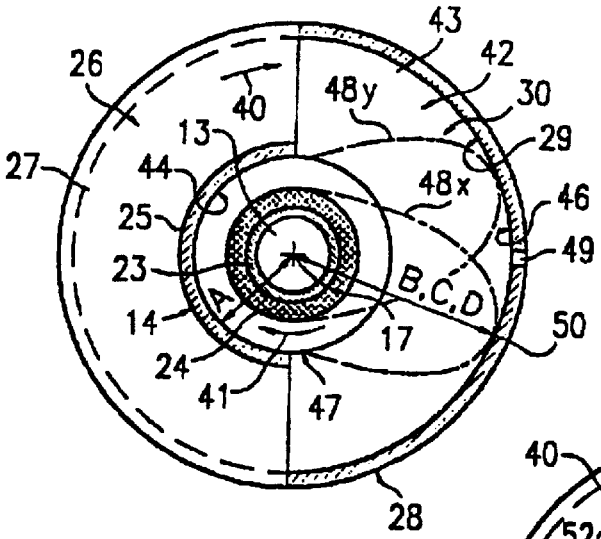
Figure 6:
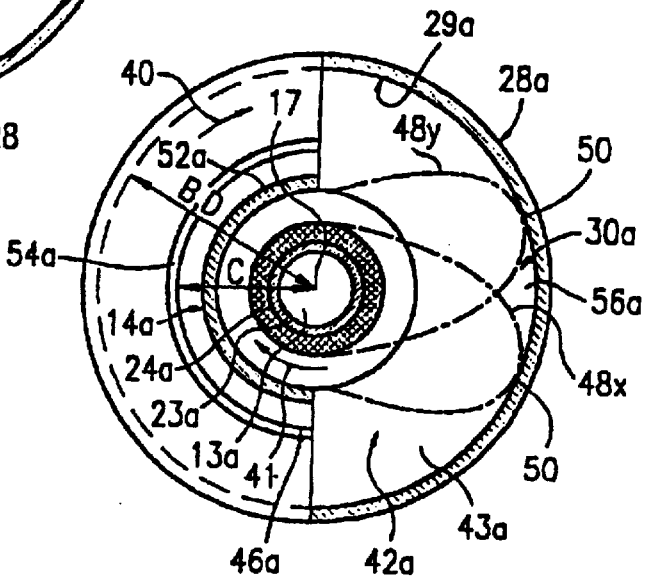
Figure 5:
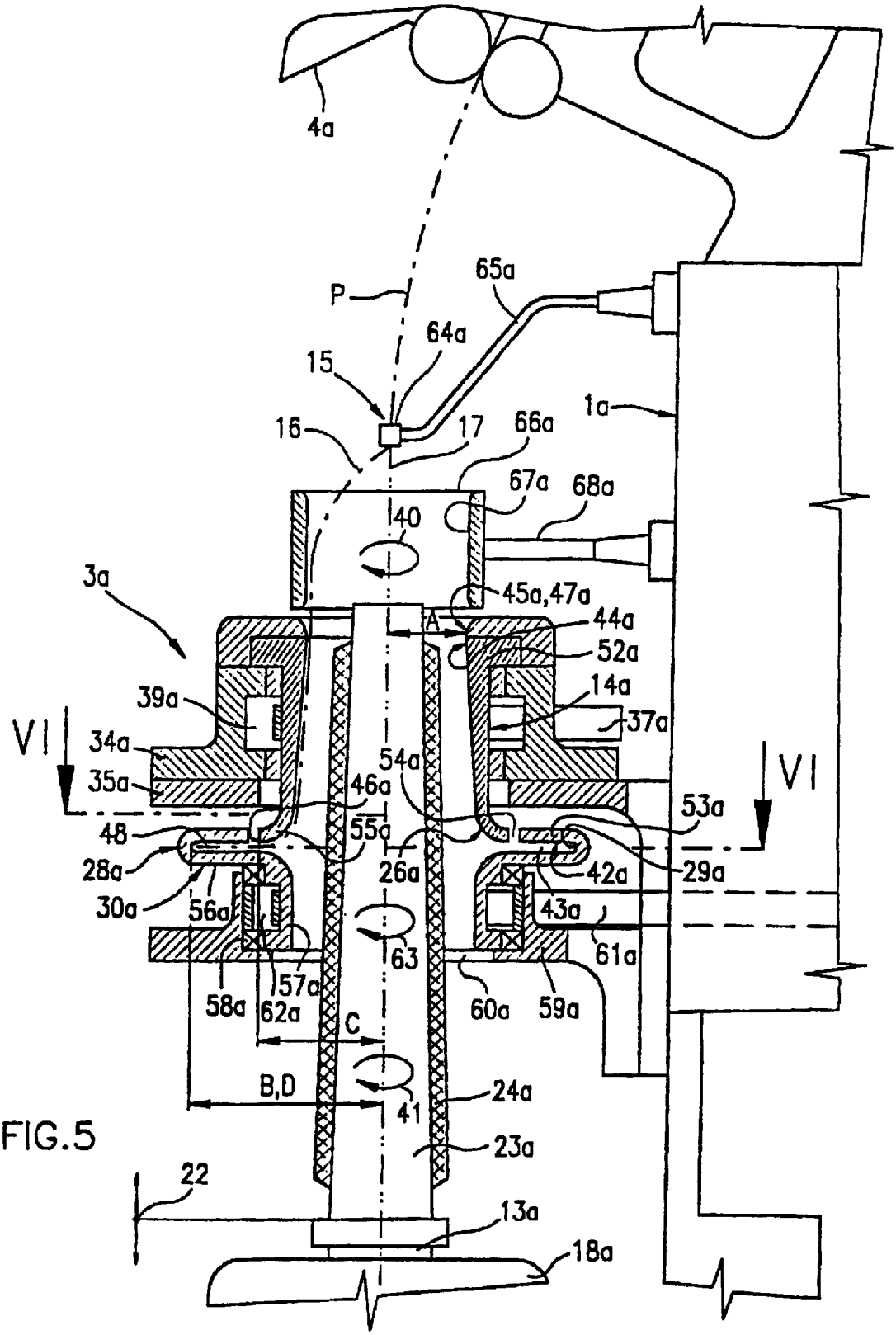
Figure 7:
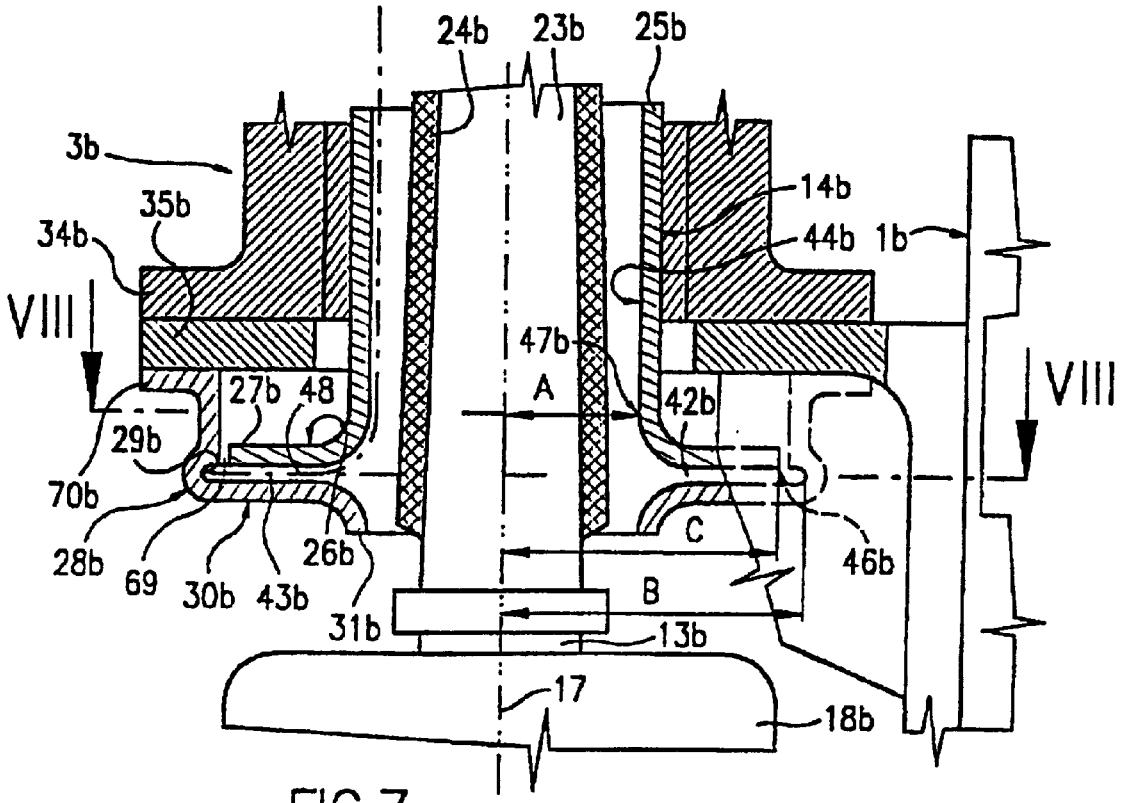
Figure 8:
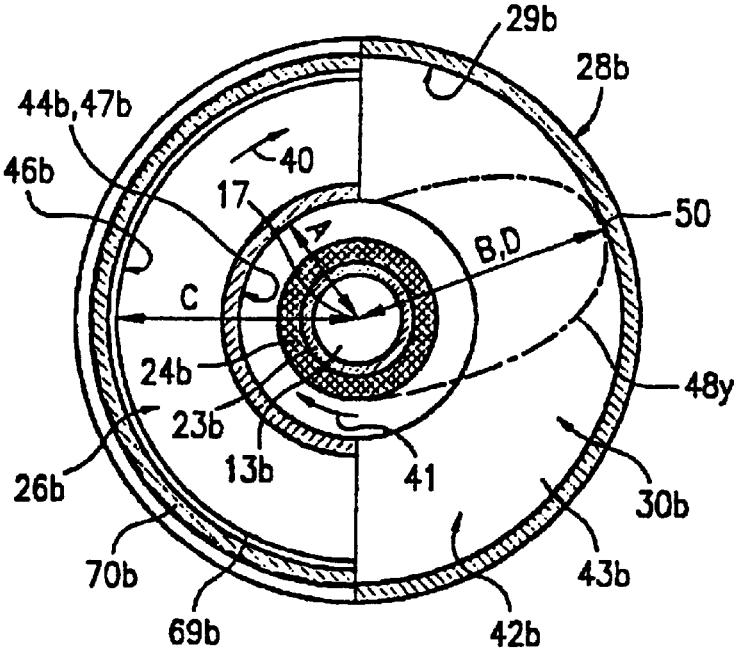
Figure 9:
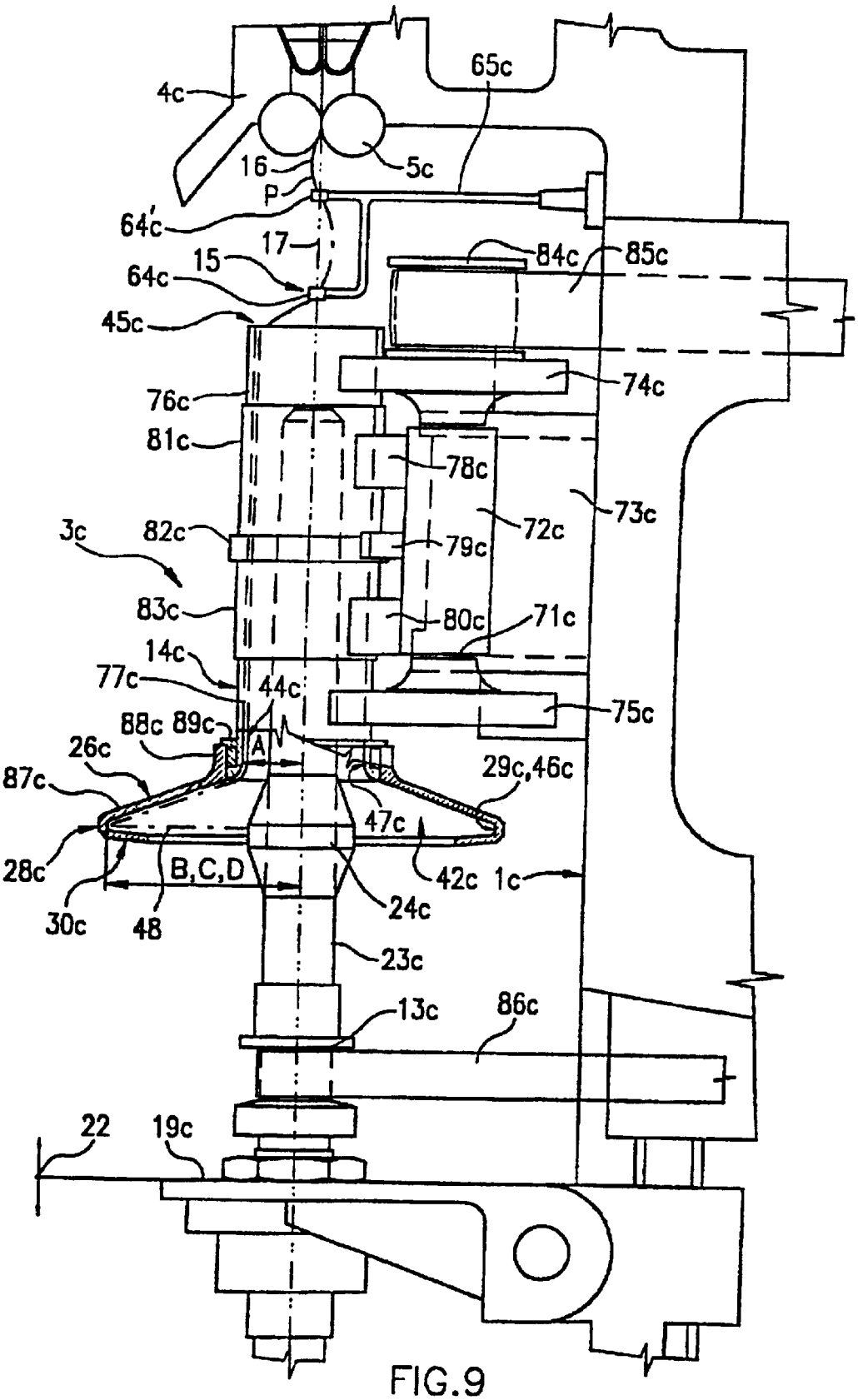
Figure 10:
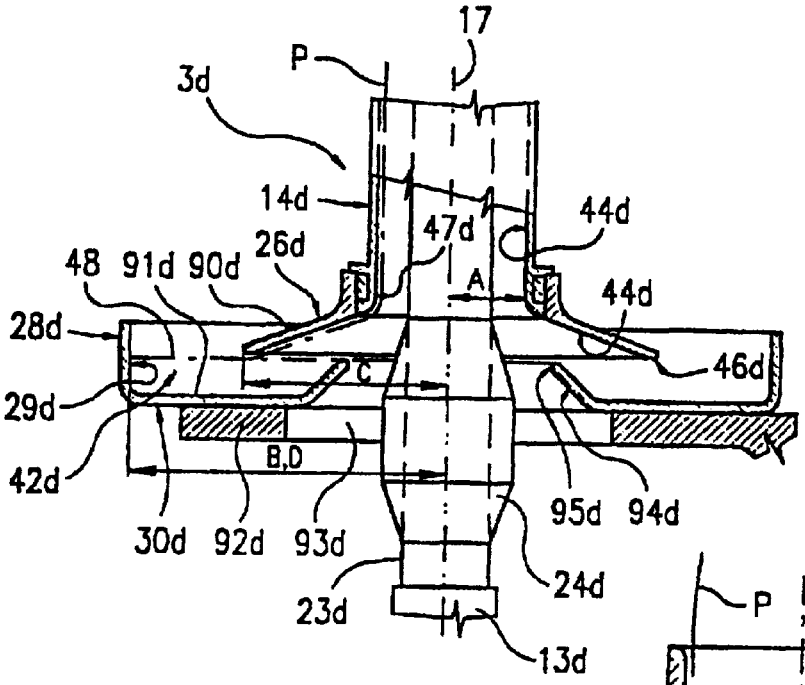
Figure 11:
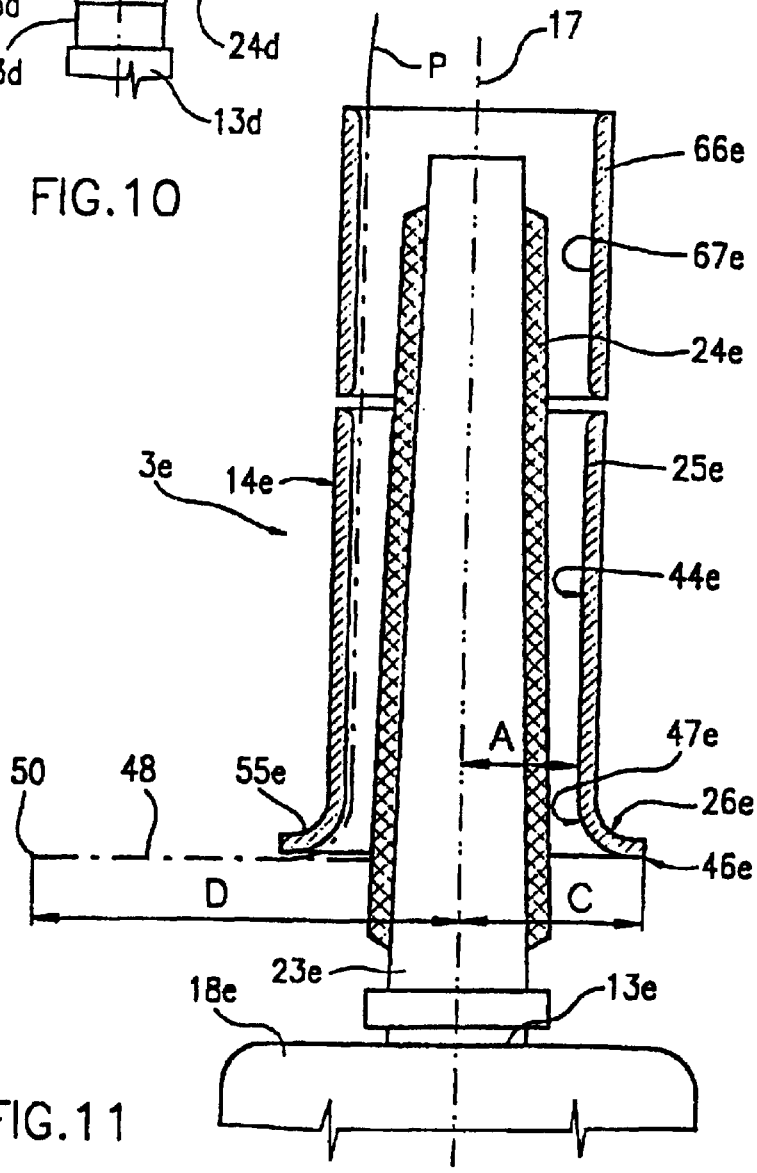
Figure 12:
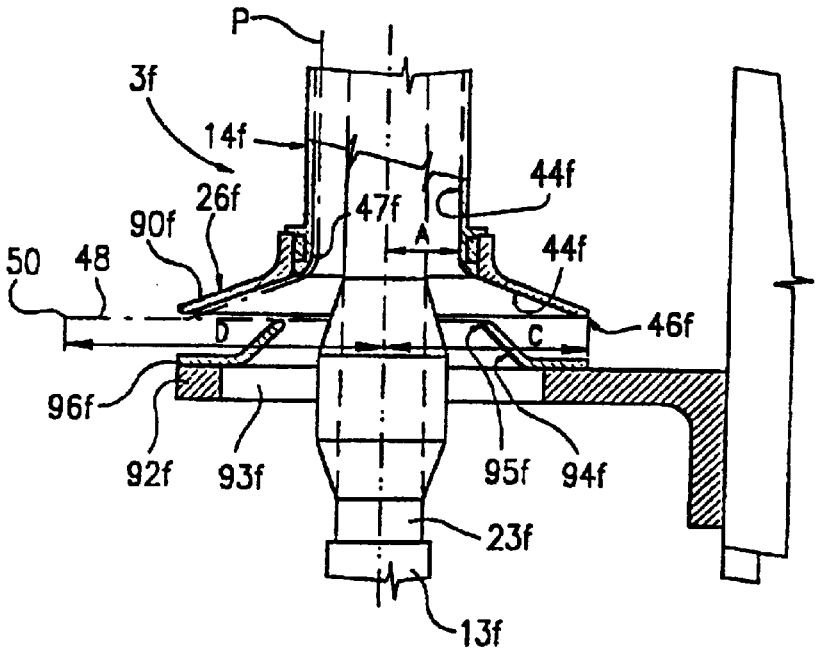
Figure 13:
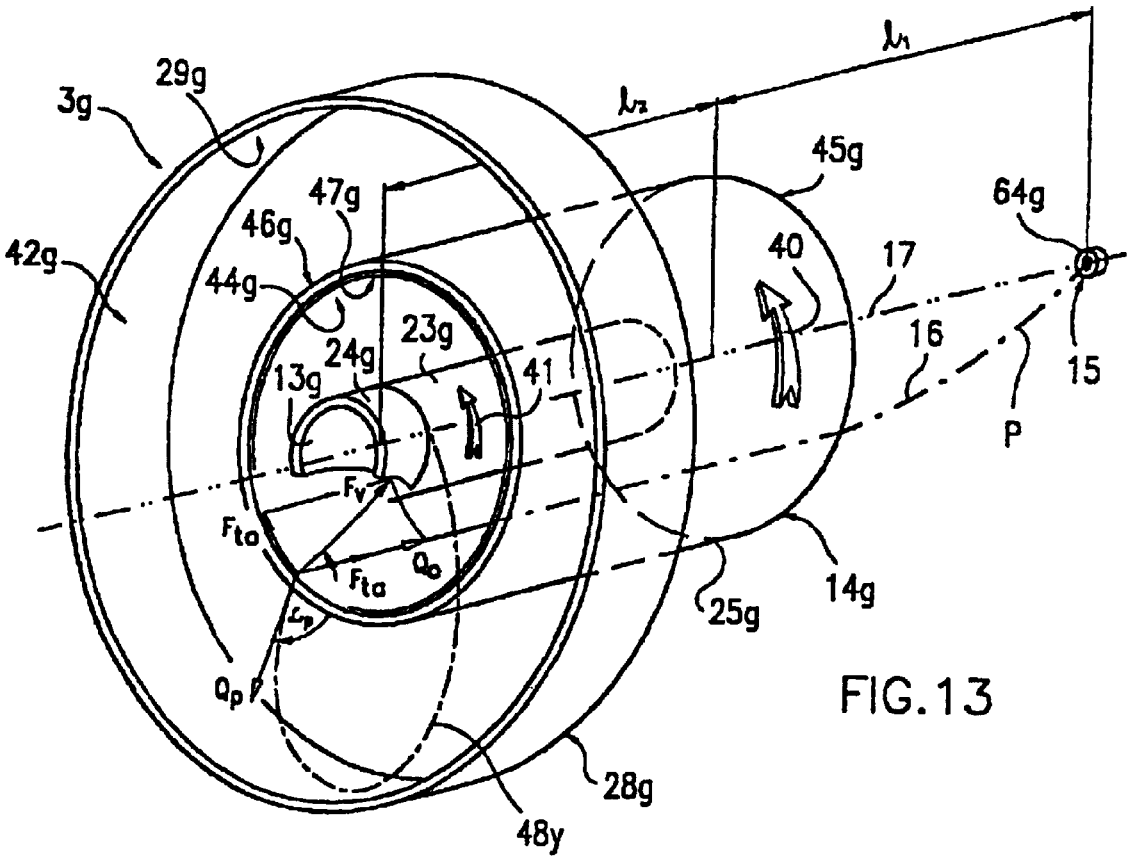
Figure 18:
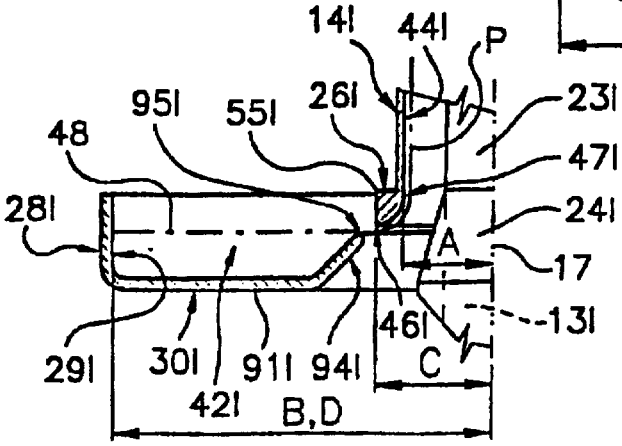
Figure 21:
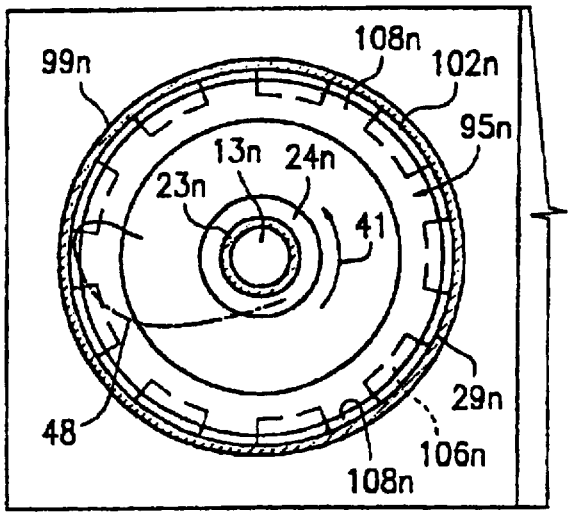
Figure 19:
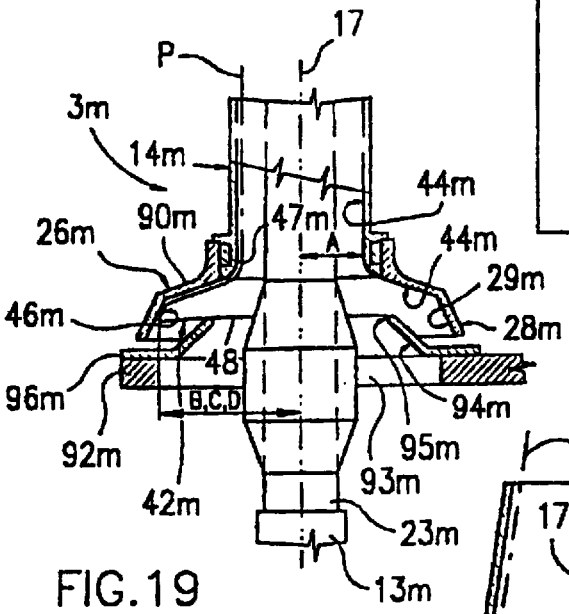
Figure 20:
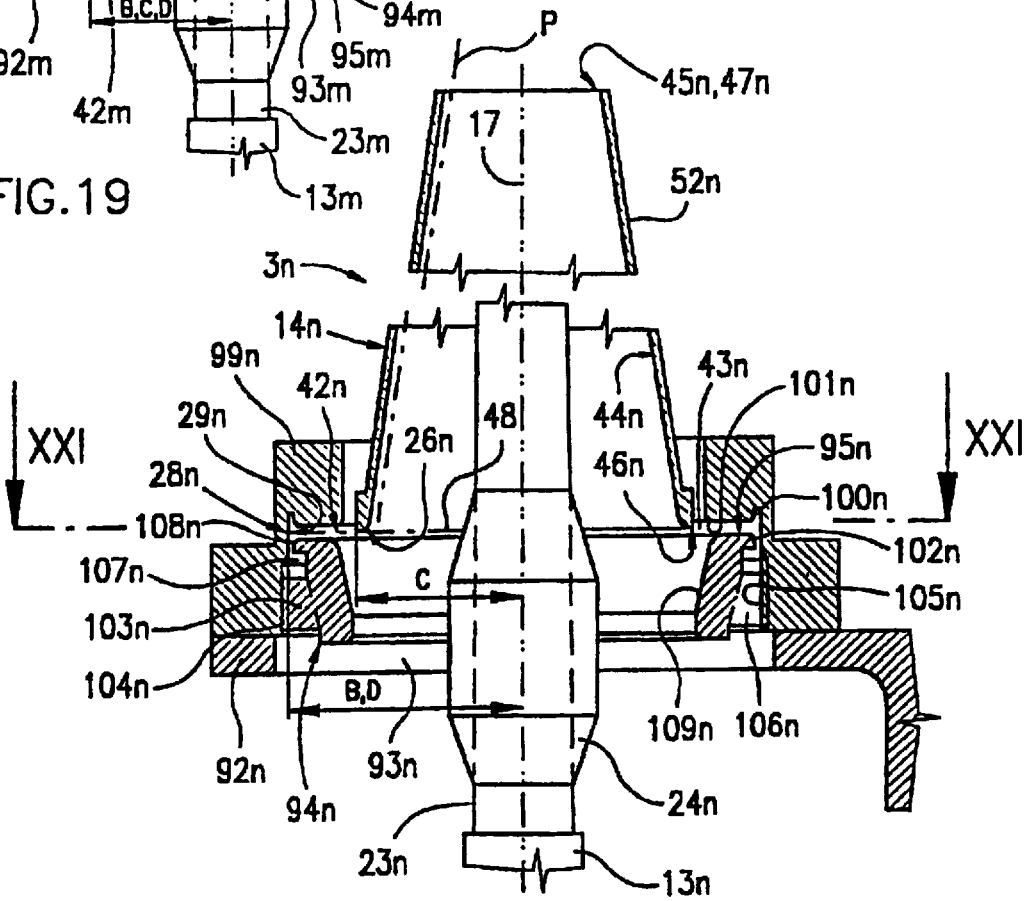

Characteristics of the invention and further characteristics and advantages of the arrangement according to the invention can be inferred from the following description of examples of execution with the help of the drawings. They show:

FIG. 1 a side view of the schematically illustrated spinning system with the twisting and coiling mechanism in partial section, FIG. 2 a detailed view of the twisting and coiling mechanism according to FIG. 1 on a larger scale and in axial section, FIG. 3 a detailed view of a lower section of the balloon limiter according to FIG. 2 on a larger scale and in axial section, FIG. 4 the cross-section along the line IV—IV according to FIG. 3, FIG. 5 a partial side view of the spinning system with a variant of the twisting and coiling mechanism in axial section, FIG. 6 the cross-section along the line VI—VI according to FIG. 5, FIG. 7 a partial side view of the variant of the twisting and coiling mechanism in axial section, FIG. 8 the cross-section along the line VI—VI according to FIG. 7, FIG. 9 a partial side view of the spinning system with the other variants of the twisting and coiling mechanism in partial section, FIGS. 10 through 12 the partial views of the variants of twisting and coiling mechanisms in axial section, FIG. 13 a schematic axonometric view of a variant of the twisting and coiling mechanism, FIGS. 14 through 20 the partial views of further variants of twisting and coiling mechanisms in axial section, and FIG. 21 the cross-section along the line XXI—XXI according to FIG. 20.

THE PROCESS FOR IMPLEMENTING THE INVENTION

In FIG. 1 is the complete spinning system for spindle spinning, arranged at the frame 1 of the spinning machine, whose basic componentries form the feed device 2 of the fiber formation and the twisting and coiling mechanism 3 with an upstream control point for the beginning of the forming of the yarn balloon. In the case of the spinning system for spindle spinning, the feed device 2 is embodied by the typical draft device 4 with the exit rollers 5.

The draft device 4 is known in the widest variety of designs of spindle spinning or jet spinning and from further spinning systems, such that it is not described in more detail. The purpose of the draft device is to process the submitted fiber band in such a way that at the exit from the draft device a small band of fiber is available the longitudinal density of which corresponds to the longitudinal density of the spun yarn P. Mounted over the draft device 4 on the holder 6 and adjustable on the vertical rod 7 is a roving spool 8, from which unwinds the roving 9 that is fed over a guide 10 into the draft device 4. Indicated by the broken lines on the right side of FIG. 1 is an alternative arrangement of the supply of the draft device 4 with the band of fiber 11 drawn out of a can 12.

The twisting and coiling mechanism 3 (FIGS. 1, 2) consists of the spindle 13 and the balloon limiter 14 arranged concentrically to the spindle 13. Assigned to the draft device 4 is a control point 15 for the beginning of the forming of the yarn balloon 16 of the yarn P formed. This control point is mounted on the surface of at least one of the exit rollers 5 of the draft device 4 as a control contact for the yarn with the corresponding exit roller or the exit rollers 5. The arrangement of the control point 15 in the area of the clamping point of the exit rollers 5 makes it possible for the yarn P formed to exit without the typical yarn guide from the draft device 4 directly into the twisting and coiling mechanism 3.

The electric drive motor 18 of the spindle 13 is mounted on the spindle rail 19, which is mounted sliding by means of the sleeve 20 along the vertical guide rod 21, which is a component of the known, not illustrated, device for actuating the program-controlled, vertical reverse motion of the spindle 13 in the direction of the double arrow 22. Alternatively, the spindle 13 may also be operated with other typical drive means, e.g. with a belt transmission.

A tube 23 (FIG. 2) for the yarn coil 24 is placed on the spindle 13. The program of the motion of the spindle rail 19 in the direction of the double arrow 22 is determined by the selection of yarn coil 24. In the case of an alternative, not illustrated, kinematically reversed arrangement of the spindle 13 and the balloon limiter 14, the spindle is attached in stationary manner to the frame 1, while the balloon limiter 14 executes a vertical movement along the spindle 13.

The balloon limiter 14 is formed, for example, from a hollow cylinder 25 which has, on the side facing away from the control point 15, a funnel-shaped mouth 26 in the form of a radial flange 27. The balloon limiter 14/the funnel-shaped mouth 26 goes over into a limit ring 28 which is concentric to the axis 17 of the spindle 13 and which bears on its inside a limit wall 29, advantageously with a concave profile. This limit wall 29 goes over into the side wall 30 which runs essentially parallel with the radial flange 27 and ends in a short flange 31 that defines the opening for the passage of the spindle 13 and the tube 23 with the yarn coil 24 (FIGS. 2, 3).

The cylinder 25 is mounted rotating on aerostatic or roller bearings 32 in a two-piece sleeve 33, whose flange 34 is attached with devices not illustrated to the rail 35, which is attached with devices not illustrated to the frame 1 of the spinning system. The balloon limiter 14, which goes through the concentric opening 36 of the rail 35, is driven by the belt 37 of the electric motor 38 attached to the frame 1 (FIG. 1). The two-piece sleeve 33 has an inner radial groove 39 with a not illustrated radial opening for the entry and exit of the belt 37. The rotation of the balloon limiter 14 in the direction of the arrow 40 runs in the same direction as the rotation of the spindle 13 in the direction of the arrow 41. Should the occasion arise, the cylinder 25 can be produced as a rotor of the electric drive motor or it can be driven by a driven friction roll and the like. The limit ring 28, the funnel-shaped mouth 26 of the balloon limiter 14 and the side wall 30 delimit the direction-indicating cavity 42 that has the shape of a radial gap 43 (FIG. 3). The purpose of the direction-indicating cavity 42 will be explained later.

The balloon limiter 14 has an inner work surface 44 for contact with the yarn P, which is achieved between the entry end 45 and the exit end 46 (FIG. 2). The work surface 44 is the part of the surface of the cavity of the balloon limiter 14 against which the formed yarn is pressed by the centrifugal force and with which this yarn is entrained. The exit end 46 is situated on the work surface 44 in the greatest diameter of the limit wall 29 (FIGS. 2, 3). For the purpose of the invention, other forms of the work surface 44 in the cylindrical part of the balloon limiter 14 are also suitable. For example: the work surface is shaped in the middle as a bushing that widens conically toward the entry end on one side and toward the exit end on the other side.

The cylinder 25 is advantageously thin-walled and made of a light metal alloy or a composite. It is desirable for the work surface 44 to have a layer of a suitable material to ensure a low degree of friction with respect to the yarn, and for it to be highly wear-resistant. Should the occasion arise, to reduce the frictional properties with respect to the yarn, the work surface may be provided with a groove or a molded rib to produce ventilation effects; they usefully reduce direct contact of the yarn with the work surface of the balloon limiter, but on condition that the work surface is still able to entrain by the friction the yarn that runs through it.

Delimited on the work surface 44 is a peripheral stop 47 for the transition of the yarn P from the work surface 44 into the rotating, open loop 48, formed by the centrifugal force, as will be explained further. In the example of construction in FIG. 3, the peripheral stop 47 is situated in the transition area of the cavity from the cylinder 25 into the funnel-shaped mouth 26, which forms the smallest diameter of the work surface 44 of the balloon limiter 14. In another case, for example when designing the work surface with radial ribs (not illustrated), this peripheral stop may be situated in the last smallest diameter of the work surface 44, in the direction of movement of the yarn P through the balloon limiter 14. The radial distance A of the peripheral stop 47 from the axis 17 of the spindle 13 is smaller than the radial distance B of the limit wall 29 of the limit ring 28 from the axis 17 of the spindle 13, whereby this radial distance B is equal to the radial distance C of the exit end 46 from the axis 11 of the spindle 13 (FIGS. 3, 4). In FIGS. 3 and 4, the limit ring 28 is pictured with radial or tangential ventilation openings 49 (for reasons of simplification of the fig., only one ventilation opening 49 is drawn in), the purpose of which will be explained later. The direction of rotation of the spindle 13 and of the balloon limiter 14 according to the arrows 40, 41 is basically parallel.

While the work surface 14 rotates at rotations $n_{pp}$, the spindle 13 rotates for example only at rotations $n_v<n_{pp}$. It is therefore important that in operation, the movement of the balloon limiter 14 with respect to the rotation of the spindle 13 is always bound to a constant higher angular velocity of the balloon limiter 14 by means of known mechanical, electromechanical or electronic bonds, depending on which drive of the spindle 13 and of the balloon limiter 14 is used.

It is mentioned above that the balloon limiter 14 goes over into the limit ring 28. According to the present invention, a limit ring 28, stable in its position and concentric with the spindle 13, is adjacent to the balloon limiter 14 in the direction of movement of the yarn P through the balloon limiter 14. The word "is adjacent to" means that the limit ring 28 is either movably connected with the balloon limiter 14, as shown by FIGS. 1 through 3, or is arranged independently, either fixed or movably with its own drive, as will be indicated further on.

The spinning system according to FIGS. 1 through 4 operates as follows:

The fiber formation goes through three phases of change during the spinning process. In the section between the draft device 4 and the exit end 46 of the work surface 44, the "yarn is formed, in the section between the exit end 46 of the work surface 44 and the tube 23, the "yarn is reshaped" and on the tube 23 is the "resulting yarn". To simplify the description, unless otherwise necessary, the expression "yarn" will be used.

A band of fiber with the longitudinal density of the resulting yarn emerges from the draft device 4 into which the roving 9 unwound from the roving spool 8 is fed. Immediately after the clamping point of the exit rollers 5 of the draft device 4, the fiber formation is compacted by twists that are imparted to the fiber formation on the one hand by the action of the twisting of the beginning of the yarn P on the tube 23 due to the rotations ($n_v$) of the spindle 13 and, on the other hand, by additional twists, caused by the rotations ($n_{pp}$) of the work surface 44 over which the yarn P entrained by it moves. A result of the rotational relation of the spindle 13 and the balloon limiter 14 is a high degree of twist in the yarn P in its section between the clamping point of the exit rollers 5 and the exit end 46 of the work surface 44 (FIG. 2). The beginning of the aforementioned yarn section is not directly in the clamping point of the exit rollers 5, because a small band of fiber emerges from this clamping point that is pulled by the rotation into the so-called rotation triangle whose vertex is the actual point of the beginning of the formed yarn balloon. For simplification, this small part of the length in the indicated yarn section can be ignored.

After the peripheral stop 47, the rotating yarn stretches, as a result of the action of the balance between the centrifugal force caused by the weight of the yarn, the reaction frictional force of the yarn during its movement over the work surface 44, and the reaction coiling force, into the rotating, open loop 48 and enters the radial gap 43 in which it is radially bound by the limit wall 29 over which the reverse bending 50 of the rotating, open loop 48 moves. The aforementioned peripheral stop 47 is delimited by the beginning of the rotating, open loop 48. The stretching/shaping of the rotating, open loop 48 is also influenced to a certain degree by the pneumatic force that act in the point of forming of the loop. Since these pneumatic forces are unessential for the forming of the rotating, open loop, they are not explained in greater detail in the description.

The radial distance D of the reverse bending 50 of the rotating, open loop 48 from the axis 17 of the spindle 13, which is greater than the radial distance A, influences the value of the centrifugal force the action of which causes the rotating, open loop 48 to form. In the case of a radial limitation of the rotating, open loop 48, the following physical processes run their course.

In the beginning of the forming of the rotating, open loop 48, it rotates freely in the space of the radial gap 43. As a result of the predominant size of the component of the inner force in the yarn, which is directed in the tangential direction to the periphery of the work surface 44, over the reaction frictional force directed in the same tangent, the yarn P shifts along the periphery of the work surface 44 against the direction of its rotation. In the meantime, the rotating, open loop 48 gradually enlarges as a result of the predominant inner force of the yarn over the resultant of the forces acting on the yarn sliding over the work surface 44, until the moment when its reverse bending 50 comes into contact with the limit wall 29 of the limit ring 28. As the first contact of the yarn with the aforementioned wall occurs, the yarn in its reverse bending 50 is entrained with the rotating, open loop 48 in the direction of rotation of the work surface 44, and this results in a coiling of the yarn's elementary part corresponding to the periphery onto the tube 23 and a corresponding elementary reduction in size of the rotating, open loop 48. In this way, the yarn's contact with the limit wall 29 is limited. It is thus clear that a principle develops of regulation of the radial distance of the reverse bending 50 of the rotating, open loop 48 from the axis 17 of the spindle 13 and thus a regulation of the coiling conditions for the yarn P onto the tube 23. In the radial gap 43 in which the yarn P begins to take the shape of the rotating, open loop 48, for the purpose of proper introduction onto the tube 23, the originally more highly twisted yarn changes in such a way that the originally excessive twist is eliminated. The section of the reshaped yarn begins between the exit end 46 and the tube 23, onto which the resulting yarn P is coiled with the desired twist Z. The formed yarn as well as the reshaped yarn P is thus more compacted by the additional twist, and this is made use of to obtain a very high degree of productivity of the yarn. This productivity can be significantly greater than with the peak productivity levels of ring spinning and it is therefore clear that the spindle may have extremely high rotational speeds, in connection with which the resulting yarn has the nature of classic ring spun yarn and even further advantages in the surface structure, as will be mentioned later.

The purpose of the direction-indicating cavity 42, especially of the radial gap 43, is the positional orientation of the rotating, open loop 48 in conformity with the coiling of the yarn P onto the tube 23.

When the twisting and coiling mechanism 3 starts up, due to the influence of the centrifugal force caused by the mass of the yarn, the rotating, open loop 48 forms which consumes the fiber formation delivered by the draft device 4 and it increasingly expands and its reverse bending 50 distances itself from the axis 17 of the spindle 13. In this first phase, the yarn does not yet coil itself onto the tube 23. The rotating, open loop 48 and the spindle 13 rotate in synchronous rotations, whereby there occurs between the yarn P and the work surface 44 a radial slip which balances out the difference in rotations between the spindle 13 and the work surface 44.

This is the first phase, during which the yarn is not yet coiled onto the tube 23. In the subsequent, second phase, with widenings of the distance of the reverse bending 50 of the rotating, open loop 48 from the axis 17, there is either a gradual or erratic increase in the frictional forces that cause the coiling of the yarn P onto the tube 23, namely in such a way that in a $n_{pp}>n_v$ relation, the rotating, open loop 48*x* illustrated in broken line overtakes the spindle 13 in its rotation and inversely, in a $n_{pp}<n_v$ relation, the rotating, open loop 48*y* delays in its rotation in relation to the spindle 13 (FIG. 4). In this second phase, the yarn P is coiled onto the tube 23 and the slip between the yarn and the work surface 44 becomes smaller.

The spinning process is characterized by a very rapid alternation of the two indicated phases, which goes into the continuous process in which there occurs a mutual pervasion of both phases. At both rotation relations $n_{pp}>n_v$ and $n_{pp}<n_v$, it is necessary for the tractive force in the yarn to have a specific value, and not too low a value, where the filling of the rotating, open loop 48 with yarn would not be able to be completed, but not too great a value, either, such that the tensile stress in the yarn would not cause the yarn to draw and thereby would not cause a loss of the yarn stretching necessary for the subsequent processing stages.

Characteristic for the rotating, open loop 48, which overtakes the spindle 13 in its rotation or delays in its rotation in relation to the spindle 13, is its open form which is caused by dynamic effects on the yarn. The forces acting on the yarn are influenced by many factors, above all by the speeds of the spindle 13 and the balloon limiter 14, as well as frictional characteristics and the shape of the work surface 44 as well as of other components with which the yarn comes into contact.

The above shows that the rotating, open loop 48 itself forms a force control means that acts on the yarn P before it is coiled onto the tube 23 of the spindle 13.

Selection of the rotations $n_{pp}$ in relation to $n_v$ is dependent, in a $n_{pp}>n_v$ relation, on the technological procedure when spinning various degrees of yarn fineness and on the requirements for the resulting twist properties of the yarn.

The condition for the spinning process to progress satisfactorily with a favorable $n_{pp}>n_v$ relation is for the $n_{pp}$ rotations to have at least the value of the relation $$n_{pp} = n_v \cdot \frac{Z \cdot 0_{\min} + 1}{Z \cdot 0_{\min}}$$

where $0_{min}$ signifies the minimum circumference of a yarn coil 24 on the tube 23, or in other words, the smallest circumference of the tube 23 in the area intended for coiling the yarn, and Z signifies the number of twists brought into a unit of length of the yarn.

In an extreme case of the $n_{pp}>n_v$ relation, the relative rotations $n_r$ of the rotating, open loop 48 in relation to the work surface 44 are in the interval from 0 to n.

In this connection, the following relation applies:

$$n = n_v \cdot \left( \frac{Z \cdot 0_{\min} + 1}{Z \cdot 0_{\min}} - \frac{Z \cdot 0_{\max} + 1}{Z \cdot 0_{\max}} \right) > 1,$$

where $0_{max}$ signifies the greatest circumference of a yarn coil 24 of the yarn on the tube 23.

The above shows that even in a borderline case of the relation selected, namely a minimal difference between $n_{pp}$ and $n_v$, practically throughout the process of creation of the yarn coil 24 on the tube 23, particularly of a conical yarn coil, there occurs a relative movement of the rotating, open loop 48 in relation to the work surface 44.

The relative movement of the rotating, open loop 48 is also accompanied by a relative movement of the formed yarn P not only crosswise over the work surface 44 from its entry end 45 to its exit end 46, but also by a relative movement along the periphery of the work surface 44, in connection with which this movement has a positive effect on the yarn formed. The peripheral movement of the formed yarn reduces its contact with the work surface 44 and thereby, the level of the reaction frictional force acting against the movement of the drawn yarn crosswise over the work surface 44 is also reduced. The peripheral movement at the same time rounds off the surface of the yarn and in this way usefully reduces its hairiness.

Under certain circumstances, particularly in the case of a greater selected difference between $n_{pp}$ and $n_v$, there also occurs a partial rolling of the formed yarn, which additionally compacts it temporarily, particularly in its section between the control point 15 and the limit wall 29 of the limit ring 28. The yarn in the rotating, open loop 48 nevertheless does not come into intensive mechanical contact, in such a way that no bundles of the surface fibers of the yarn are formed which would otherwise lead to a greater undesired stiffness of the yarn.

The purpose of the ventilation openings 49 in the limit wall 29 of the limit ring 28 is a continuous cleaning of the radial gap 43 of remainders of free fibers and other impurities that are drawn into this space during the spinning process. At the same time, these ventilation openings form an additional current of air in the radial gap 43 which usefully supports a stretching of the yarn into the rotating, open loop 48.

For the operation of spinning in or startup, the spinning system (FIG. 1) is equipped with a foldable suction nozzle 51 and a not illustrated system for securing and releasing the housing 20 to/from the guide rod 21 and with a pivoting arrangement of the spindle rail 19. After stopping the balloon limiter 14 and the spindle 13, the spindle rail 19 with the spindle 13 is folded away into the lower position shown in broken line. The operator searches for the end of the yarn P on the tube 23 and threads the necessary yarn length through the balloon limiter 14, for example with a threading needle. When the spindle rail 19 moves, the length of the yarn threaded through is straightened into the working position in such a way that it is somewhat looser in the yarn forming section, to compensate for the forces acting on the yarn, because at the moment of spinning startup, the yarn is not yet compacted by an excessive number of twists. Throughout these manipulations, the band of fiber from the exit rollers 5 of the draft device 4 is sucked off by the suction nozzle 51, which was folded into working position (FIG. 1), into a not illustrated supply container for recyclable fiber material. After the typical connecting of the yarn to the emerging band, the spinning process begins by starting up the units of the twisting and coiling mechanism 3 in a $n_{pp}>n_v$ relation. At startup of the work surface 44 as well as the spindle 13. The looser yarn in the section of its formation is not under tensile stress in standard manner. This makes it possible, as a result of the excessive weight of the centrifugal force, acting on the yarn, over the frictional force between the yarn being created and the work surface 44, to form the beginning of a rotating, open loop 48 in the radial gap 43 while at the same time forming a supply of newly formed and reshaped yarn. The indicated procedure also applies to the elimination of a yarn rupture.

For the purpose of automation of the spinning process, the spinning machine can be equipped with known working means for the programmed controlling of spinning startup operations and yarn rupture eliminations which are controlled by the yarn rupture sensors. The reference letters A, B, C, D, signifying the radial distance of the peripheral stop 47 (A), the limit wall 29 (B), the exit end 46 (C) and the reverse bending 50 of the rotating, open loop 48 (D) from the axis 17 of the spindle 13, are shown in FIGS. 3 and 4 and listed in the text for these figures. These reference letters are also used in other figures and in the subsequent text.

In FIG. 5 and in the corresponding section in FIG. 6, a spinning system is shown with a variant of the twisting and coiling mechanism 3*a*. The balloon limiter 14*a* is embodied by a hollow rotating body 52*a* the work surface 44*a* of which has a conical profile widening from the entry end 45*a*. The mounting and the drive of the balloon limiter 14*a* are identical to the design of the balloon limiter 14 according to FIG. 2, in such a way that the corresponding reference numbers of the components in FIG. 5 are provided with the index a.

The limit ring 28*a* with the limit wall 29*a* gradually goes over into the radial side wall 53*a*, which in turn goes over the air gap 54*a* into the funnel-shaped mouth 26*a* in the form of a short flange 55*a* of the balloon limiter 14*a*. On the opposite side, the side wall 30*a* continuously connects to the limit ring 28*a*; this wall is formed by a radial flange 56*a* of a centric mold tube 57*a*, which is pivoted in the bearings 58*a* of a holder 59*a* and through the concentric opening 60*a* of which runs the spindle 13*a*, driven by the electric motor 18*a*, with the tube 23*a* and the yarn coil 24*a*. The holder 59*a* is attached to the frame 1*a* with means not illustrated.

The mold tube 57*a* is operated with a belt 61*a* of a not illustrated electric motor attached to the frame 1*a*. The belt 61*a* runs through a radial groove 62*a* formed between the holder 59*a* and the mold tube 57*a* and which is provided with a not illustrated radial opening for the entry and exit of the belt 61*a*. The limit ring 28*a*, the radial side wall 53*a*, the funnel-shaped mouth 26*a*, and the side wall 30*a* delimit the direction-indicating cavity 42*a* in the form of a radial gap 43*a*. (FIG. 5, 6). The peripheral stop 47*a* arranged in the narrowest diameter of the work surface 44*a* of the balloon limiter 14*a* is identical to the entry end 45*a* of the work surface 44*a*, whose exit end 46*a* is situated at the inner edge of the short flange 55*a*. The radial distance A of the peripheral stop 47*a* from the axis 17 of the spindle 13*a* is smaller than the radial distance C of the exit end 46*a* from the axis 17 of the spindle 13*a*.

The rotation of the mold tube 57 in the direction of the arrow 63 is identical to the rotation of the balloon limiter 14*a* in the direction of the arrow 40. The control point 15 for the forming of the beginning of the yarn balloon 16 is formed alternatively by the guide unit 64*a* mounted between the draft device 4*a* and the twisting and coiling mechanism 3*a*. The molded arm 65*a* of the guide unit 64*a* is attached to the frame 1*a* with means not illustrated.

Placed before the rotating balloon limiter 14*a* is a concentric, non-rotating balloon limiter 66*a*, with an inner work surface 67*a*, which is carried by a leg 68*a* attached to the frame 1*a* with means not illustrated. For the construction of the twisting and coiling mechanism 3*a*, the relations A<C<B, D apply. Due to the use of the non-rotating balloon limiter 66*a*, however, the use of a shorter and thereby also lighter, driven balloon limiter 14*a* is made possible.

The spinning process on the spinning system according to FIG. 5 progresses with rotation relations of, for example $$n_{pp}>n_v$$

and $$n_p=n_{pp}\pm\delta n,$$

where $n_p$ signifies the rotations of the limit ring 28*a* and δn signifies the empirically determined value of the rotation that has a positive influence on the physical properties of the yarn of a high-quality spinning process.

The balloon-forming yarn P that passes through the non-rotating balloon limiter 66*a* begins, already as of the peripheral stop 47*a*, to stretch into a rotating, open loop 48, in connection with which the forming of the yarn progresses identically as on the spinning system according to FIG. 2 except for the results of the speed $$n_p=n_{pp}\pm\delta n$$

on the formed yarn P at the transition between the exit end 46*a* of the work surface 44*a* and the radial side wall 53*a*. For the forming of the rotating, open loop 48, the relation A<D then applies.

The purpose of the conical profile of the work surface 44*a* of the balloon limiter 14*a* is to ensure a self-cleaning action of the work surface 44*a* and a facilitation of the process of spinning startup.

In FIG. 6, which shows one section of the twisting and coiling mechanism 3*a* according to plane VI—VI from FIG. 5, the rotating, open loop 48*x* running in front of or overtaking the spindle 13*a* in its rotation is formed, in the $n_{pp}>n_v$ relation and the rotating, open loop 48*y* delayed in its rotation in relation to the spindle 13*a* is formed, in the $n_{pp}<n_v$ relation.

In FIGS. 7 and 8, another twisting and coiling mechanism 3*b* is shown, in connection with which the parts corresponding to the parts according to FIG. 2 have the same reference numbers as the index "b". The twisting and coiling mechanism 3*b* has a limit ring 28*b* with limit wall 29*b* that connects over the gap 69*b* to the funnel-shaped mouth 26*b* in the form of a radial flange 27*b* and goes over on the one hand into the side wall 30*b* ended with the short flange 31*b* and, on the other hand, into the supporting flange 70*b* attached to the rail 35*b* with means not illustrated. The limit ring 28*b,* the funnel-shaped mouth 26*b* and the side wall 30*b* delimit the direction-indicating cavity 42*b* in the form of a radial gap 43*b.* The peripheral stop 47*b* is situated in the transition of the cylindrical wall of the work surface 44*b* into the radial flange 27*b,* in connection with which the exit end 46*b* of the work surface 44*b* is mounted at the end of the radial flange 27*b.* In this case the relation A<C <B applies.

In the spinning process, in the $n_{pp}<n_v$ relation, the rotating, open loop 48*y* delayed in its rotation in relation to the spindle 13*a* is formed which is delimited radially by the limit wall 29*b* of the limit ring 28*b* (FIG. 8). The yarn P is continuously drawn out of the rotating, open loop 48*y* and coiled onto the tube 23*b* of the spindle 13*b.*

A certain shaping action also acts on the structural forming of the yarn; it is brought about by the transition of the yarn in the form of a rotating, open loop 48*y* from the rotating funnel-shaped mouth 26*b* of the balloon limiter 14*b* to the limit wall 29*b* of the non-rotating limit ring 28*b.* For the forming of the rotating, open loop 48*b,* the relation A<D applies.

FIG. 9 shows the spinning system with the other variant of the twisting and coiling mechanism 3*c.* The balloon limiter 14*c* is driven by a basically known friction drive. Each of the shaft pairs 71*c*—only one of which is shown—parallel with the axis 17 of the spindle 13*c* is mounted in a bearing 72*c* that is held by a holder 73*c* attached to the frame 1*c* with means not illustrated. The shaft 71*c* bears a pair of friction disks 74*c,* 75*c* that engage the friction reducer 76*c,* 77*c* of the balloon limiter 14*c.* Mounted between the bearings 72*c* on the holder 73*c* are the pole pieces of the permanent magnets 78*c,* 79*c,* 80*c,* which are placed over an air gap against the heels 81*c,* 82*c,* 83*c* of the balloon limiter 14*c.* The arrangement of the pole pieces 78*c,* 79*c,* 80*c* and the heels 81*c,* 82*c,* 83*c* ensures the axial and radial stability of the balloon limiter 14*c.* Placed at the upper end of the shaft 71*c* is a belt pulley 84*c* operated over a belt 85*c* of an electric operating motor not illustrated. The spindle 13*c* attached to the spindle rail 19*c* is operated by means of a belt transmission 86*c.*

The limit ring 28*c* goes on the one hand into the funnel-shaped mouth 26*c* formed by the conical flange 87*c* and, on the other hand, into the side wall 30*c,* which is provided with the opening for the passage of the spindle 13*c* and the tube 23*c* with the yarn coil 24*c.* The side wall 30*c,* which is relatively radially shorter than the side wall 30 in FIG. 2, widens moderately conically toward the funnel-shaped mouth 26*c.* The exit end 46*c* is situated in the greatest diameter of the concave limit wall 29*c.*

From the point of view of construction, the conical flange 87*c* is pressed by means of the bushing 88*c* onto the end heel 89*c* of the balloon limiter 14*c.* The limit ring 28*c,* the funnel-shaped mouth 26*c* and the side wall 30*c* delimit the direction-indicating cavity 42*c.* The control point 15 is formed by the guide unit 64*c* that is attached to the frame 1*c.* The molded arm 65*c* bears another guide unit which is arranged between the guide unit 64*c* and the exit rollers 5*c,* in connection with which the guide unit 64*c* is situated in the axis 17 immediately before the entry end 45*c* of the balloon limiter 14*c.* For the form of execution according to FIG. 9, the relations A<B, C, D apply.

The rotating yarn P stretches after the peripheral stop 47*c* into the rotating, open loop 48 which is formed by the shape of the direction-indicating cavity 42*c*, in connection with which the upper bough of the rotating, open loop 48 follows the wall of the conical flange 87*c,* while its lower bough goes from the concave limit wall 29*c,* without contact with the side wall 30*c,* directly onto the tube 23*c.* On the other hand, in the case of rings with a radial slit 43, 43*a,* 43*b,* a rotating, open loop forms whose boughs are situated roughly in the radial plane. For the forming of the rotating, open loop 48, the relation A<D applies.

The purpose of the other guide unit 64'*c* is the desirable reduction of the yarn balloon 16 in the section between the exit rollers 5*c* of the draft device 4*c* and the guide unit 64*c.*

The yarn coil 24*c* on the tube 23*c* forms either by typical coiling in which, at the foot of the tube, a conical base is first coiled up onto which further conical layers are then coiled parallel, in such a way that gradually a yarn coil is created from the foot of the tube to its tip, or by so-called bottle coil, which is used particularly in the spinning of bast fibers. In this second case, the conical base for the parallel coiling of further conical layers is formed directly from the cone of the tube.

These known coiling techniques make it possible to select the smallest diameter of the work surface 44*c* of the balloon limiter 14*c* only a little larger than the greatest diameter of the tube 23*c.* Its smallest reciprocal clearance is selected in such a way that the yarn that is fed over the work surface 44*c* into the rotating, open loop 48 can pass through it freely. The yarn coil 24*c* forms in the direction-indicating cavity 42*c* after the peripheral stop 47*c* in such a way that in the first phase of the coiling, the entire empty tube 23*c* is housed in the cavity of the balloon limiter 14*c* and that then during formation of the yarn coil 24*c,* the spindle 13*c* lowers according to a program until, when the yarn coil 24*c* is finished, the tube 23*c* is already outside of the balloon limiter 14*c.* Since the cylindrical cavity of the balloon limiter 14*c* does not enclose the yarn coil 24*c* during the spinning, it can have an optimal minimal diameter and thus also a low mass, which is favorable with the high operating rotational speeds of the spindle 13*c.* Inversely, for a given inner diameter of the balloon limiter, an optimal maximum yarn coil can be coiled onto the tube. It is also advantageous that the yarn coil 24*c* is not exposed to any ventilation influences that act on the yarn in the intermediate space between the work surface 44*c* and the yarn coil 24*c,* in particular with optimal minimal diameter of the work surface 44*c* and optimal maximum diameter of the yarn coil 24*c.*

In FIG. 10, a further variant of the twisting and coiling mechanism 3*d* is shown. The balloon limiter 14*d,* whose bearing and drive are not illustrated, has a funnel-shaped mouth 26*d* which is formed by a conical flange 90*d* that is attached to the cylindrical end of the balloon limiter 14*d* with the same means as the funnel-shaped mouth 26*c* in FIG. 9. The funnel-shaped mouth 26*d* or, respectively, the conical flange 90*d,* reaches with the exit end 46*d* of the work surface 44*d* into the limit ring 29*d* whose limit wall 28*d,* which lies parallel with the axis 17 of the spindle 13*d,* gradually goes over into the side wall 30*d* in the form of a concentric radial ring 91*d* which is attached by means not illustrated on the ring rail 92*d* with concentric opening 93*d* for the passage of the spindle 13*d* and the tube 23*d* with the yarn coil 24*d.* The radial ring 91*d* again goes over into a concentric conically widening guide ring 94*d,* which is ended with a guide edge 95*d.* The indicated guide edge 95*d* is situated inside the limit ring 28*d* behind a not illustrated plane running through the exit end 46*d* of the work surface 44*d,* with respect to the direction of movement of the yarn P through the balloon limiter 14*d.* The guide edge 95*d,* whose diameter is sized for the passage of the tube 23*d* with yarn coil 24*d,* is situated between the exit end 46*d* and the spindle 13*d.* The direction-indicating cavity 42*d* is limited by the limit ring 28*d.*

In operation, the yarn P entrained by the work surface 44*d* stretches from the peripheral stop 47*d* along the wall of the funnel-shaped mouth 26*d* into the rotating, open loop 48 that is radially limited by the limit wall 29*d* of the limit ring 28*d*. The lower rear bough of this loop is guided and braked by the guide edge 95*d* of the guide ring 94*d*. At a certain value of the frictional forces acting on the rotating, open loop 48 at the guide edge 95*d* of the guide ring 94*d*, a corresponding braking action can be exerted that also makes possible the $n_{pp}=n_v$ rotation relation. For the execution according to FIG. 10, the relation A<C<B applies and for the rotating, open loop 48 the relation A<D. FIG. 11 represents a variant of the twisting and coiling mechanism 3*e* with the balloon limiter 14*e* formed from a hollow cylinder 25*e*. The work surface 44*e* goes over the peripheral stop 47*e* into the funnel-shaped mouth 26*e* in the form of a short flange 55*e*, which is ended by the exit end 46*e* of the work surface 44*e*. Placed in front of the balloon limiter 14*e* is a concentric, non-rotating balloon limiter 66*e* with an inner work surface 67*e*. The bearings of the balloon limiters 14*e* and 66*e*, the drive of the balloon limiter 14*e* and the spindle 13*e* are not illustrated.

The rotating yarn P stretches due to the action of the centrifugal force caused by the mass of the yarn, from the peripheral stop 47*e* into the rotating, open loop 48, from which the yarn is continuously drawn and is coiled onto the tube 23*e*. In this form of execution the reverse bending 50 of the rotating, open loop 48 is not radially limited by any body. For the twisting and coiling mechanism 3*e* according to FIG. 11 the A<C relation applies, and the A, C<D relations apply to the forming of the rotating, open loop 48.

FIG. 12 shows the variant of the twisting and coiling mechanism 3*f* with the balloon limiter 14*f*, the design of which corresponds to the balloon limiter from FIG. 10, in such a way that the corresponding components in FIG. 12 have the same reference numbers as the index f.

The radial flange 96*f* of the guide ring 94*f* with the guide edge 95*f* is attached with not illustrated means to the stationary ring rail 92*f* with the concentric opening 93*f* for the passage of the spindle 13*f* and the tube 23*f* with the yarn coil 24*f*. The guide edge 95*f* is situated behind a not illustrated plane running through the exit end 46*f* of the work surface 44*f*. The construction of the twisting and coiling mechanism 3*f* fulfills the A<C relation.

From the formed rotating, open loop 48 whose reverse bending 50 is not radially limited by any body, the yarn P is continuously drawn off, braked by means of the guide edge 95*f* and guided to the tube 23*f*. The forming of the rotating, open loop 48 fulfills the relation A<D. Like the twisting and coiling mechanism 3*d* from FIG. 10, the twisting and coiling mechanism 3*f* also allows the $n_{pp}=n_v$ rotation relation due to the action of the guide edge 95*f* of the guide ring 94*f* on the rotating, open loop 48.

To explain the reality of the spinning process according to the invention, a comparison of the elementary forces is then made, which act in the $n_{pp}<n_v$ relation on the rotating, open loop 48 in the variant of the twisting and coiling mechanism 3*g*, which is schematically illustrated in FIG. 13. The balloon limiter 14*g* in the form of a hollow cylinder 25*g* reaches with its lower edge, which delimits the peripheral stop 47*g* and at the same time also the exit end 46*g*, into the cavity of the limit ring 28*g* with the limit wall 29*g*. Through the balloon limiter 14*g* goes the spindle 13*g* on which the tube 23*g* with the yarn coil 24*g* is placed. The guide unit 64*g* serving as a control point 15 is mounted in the axis 17 of the spindle 13*g*. The arrows 41, 40 mark the direction of rotation of the spindle 13*g* and of the balloon limiter 14*g*.

The degree of fineness of the resulting yarn, e.g. 15 tex of cotton fibers, is determined by the mass of the yarn that acts in the rotating, open loop 48*y* that delays in relation to the spindle 13*g*.

The inner forces in the yarn acting at the point of the exit end 46*g* of the work surface 44*g*, are marked with the symbol "Q" and forces acting at the same point on the surface of the yarn are marked with the symbol "F". The pneumatic forces are not taken into consideration, because their action is negligible for the given comparison.

$1_1$ (distance of the entry end 45*g* of the work surface 44*g* from the guide unit 64*g*)=100 mm $1_2$ (length of the balloon limiter 14*g*)=150 mm $n_{pp}$ (rotations of the balloon limiter 14*g*)=30,000 rpm-$^{1}$ $n_v$ (rotations of the spindle 13*g*)=30,600 rpm-$^{1}$ $r_{pp}$ (radius of the work surface 44*g*)=25 mm $r_v$ (radius of the spindle 13*g*)=12 mm $r_{vp}$ (radius of the limit wall 29*g*)=65 mm $r_b$ (radius of the yarn balloon 16 in the section between the guide unit 64*g* and the entry end 45*g* of the work surface 44*g*)$\leqq r_{pp}$ m (unit mass of the yarn with the length of 1 m)=0.000015 kg.m-$^{1}$ $\alpha_p$ (solid angle between the force pair, namely between the inner force $Q_p$ in the yarn that runs into the rotating, open loop 48*y* and the resulting force $F_v$ determined by the vectorial sum of the forces that act on the yarn bough sliding along the work surface 44*g*)=$\pi/2$ $\mu$ (friction coefficient between the yarn and the work surface 44*g*)=0.2 e (basis of the natural logarithm)=2.718

$Q_o$ (component of the inner force in the yarn that slides along the work surface 44*g*; this component is caused by the action of the yarn balloon 16 between the guide unit 64*g* and the work surface 44*g*)—as a result of its being very small, it is considered null in the calculation.

$F_{to}$, $F_{ta}$ (the frictional forces between the yarn and the work surface 44*g*, caused by the centrifugal force, are considered equal)=1.33·10-$^{1}$ N.

The inner force in the yarn at the point where the yarn runs into a rotating, open loop 48*y*, is marked with the symbol $Q_p$. The resulting force, determined as vectorial sum of the forces acting on the yarn sliding along the work surface 44*g*, is marked with the symbol $F_v$.

Based on the indicated parameters, the values $$Q_p=4.72\cdot10^{-1}\ [N]$$

and $$F_v=2.58\cdot100^{1}\ [N]$$

were defined by professional calculation.

This result shows that the inner force $Q_p$ in the yarn, defined as the resulting force of all elementary yarn sections in the rotating, open loop 48*y*, relatively easily overcomes the resultant $F_v$ of the frictional forces, that is, it easily and reliably refills yarn into the rotating, open loop 48*y*, in connection with which this refilled yarn is at the same time consumed by coiling onto the tube 23*g*. The visible excess force for refilling is also favorable for a sufficient coiling force to ensure a desired firm yarn coil 24*g* on the tube 23*g*.

FIGS. 14 through 18 show further variants of twisting and coiling mechanisms. The same details are marked in this case with the same reference numbers with corresponding index.

Figure 14:
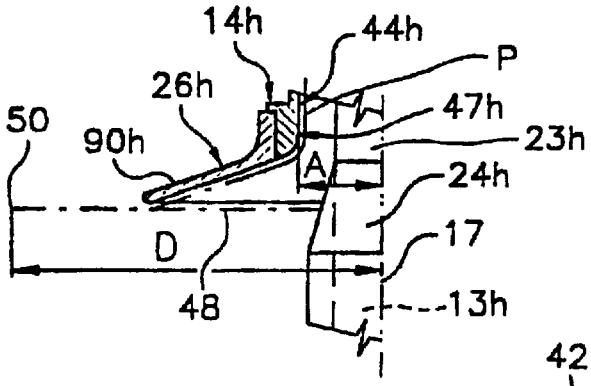

FIG. 14—Placed at the end heel of the balloon limiter 14*h* is a funnel-shaped mouth 26*d* in the form of a conical flange 90*h*. The yarn P entrained by the work surface 44*h* stretches from the peripheral stop 47*h* into a rotating, open loop 48 which is not radially delimited by any body and from which the yarn is drawn off and is coiled on a yarn coil 24*h* on the tube 23*h*.

Figure 15:
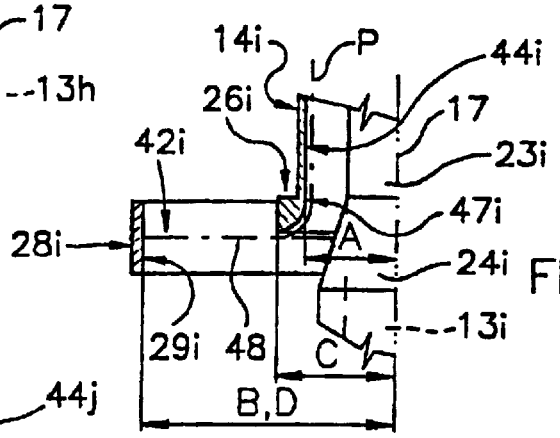

FIG. 15—The funnel-shaped mouth 26*i* of the balloon limiter 14*i* reaches into the limit ring 28*i*. The limit wall 29*i* runs parallel with the axis 17 of the spindle 13*i* and delimits the direction-indicating cavity 42*i*. The yarn P entrained by the work surface 44*i* stretches from the peripheral stop 47*i* into the rotating, open loop 48, which is radially limited by the limit wall 29*i* of the limit ring 28*i*, in connection with which the yarn P is continuously drawn off from the rotating, open loop 48 and is coiled onto the yarn coil 24*i* on the tube 23*i*.

Figure 16:
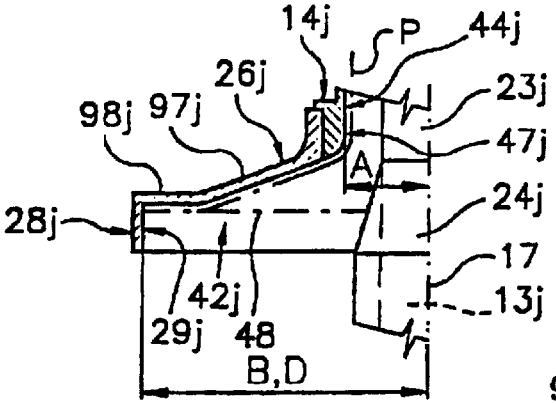

FIG. 16—The funnel-shaped mouth 26*j* is formed by a broken rotation wall 97*j* whose radial part 98*j* goes over into the limit ring 28*j* with the limit wall 29*j*, which is parallel with the axis 17 of the spindle 13*j*. From the peripheral stop 47*j* the yarn P stretches into the rotating, open loop 48 which is radially limited by the limit wall 29*j* of the limit ring 28*j*, in connection with which the yarn P is continuously drawn off from the rotating, open loop 48 and is coiled onto the yarn coil 24*j* on the tube 23*j*. The shape of the broken rotation wall 97*j* ensures that the upper bough of the rotating, open loop 48 is in frictional contact with its inner surface.

Figure 17:
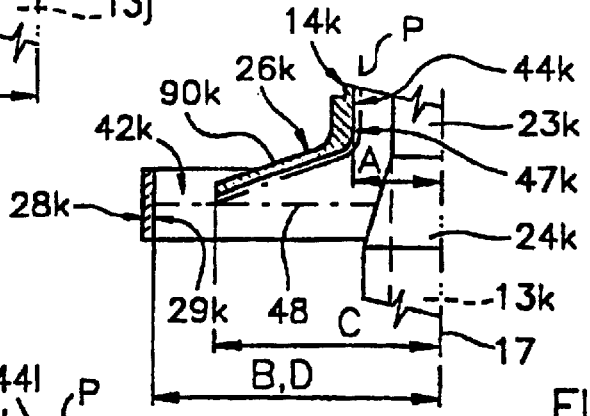

FIG. 17—The balloon limiter 14*k* goes directly into the funnel-shaped mouth 26*k* formed by a conical flange 90*k* that reaches into the limit ring 28*k* with the limit wall 29*k* which is parallel with the axis 17 of the spindle 13*k*. The yarn P entrained by the work surface 44*k* stretches from the peripheral stop 47*k* into the rotating, open loop 48 that is radially delimited by the limit wall 29*k*, in connection with which the yarn P is continuously drawn off from the rotating, open loop 48 and is coiled onto the yarn coil 24*k* on the tube 23*k*.

FIG. 18—The funnel-shaped mouth 26*l* in the form of a short flange 55*l* reaches into the limit ring 28*l* with the limit wall 29*l* which is parallel with the axis 17 of the spindle 13*l*. The side wall 30*l* in the form of a concentric radial ring 91*l* connects to the limit wall 29*l*; the side wall goes over into a conically tapering guide ring 94*l* that is ended with the guide edge 95*l* arranged inside the limit ring 28*l* behind a not illustrated plane running through the exit end 46*l* of the work surface 44*l*, outside of the short flange 55*l*, between the exit end 46*l* and the limit wall 29*l*. The yarn P stretches from the peripheral stop 47*l* in the form of the rotating, open loop 48 that is radially delimited by the limit wall 29*l* of the limit ring 28*l*. The yarn P is continuously drawn from the rotating, open loop 48, braked by the guide edge the yarn coil 24*l* on the tube 23*l*.

With regard to FIG. 5 it should also be noted that it in the $n_{pp}>n_v$ relation an open loop 48*x* forms that overtakes the spindle 13*a* in its rotation. In the event that the adjustable frictional action between the limit wall 29*a* and the rotating, open loop 48 is decisive, conditions may be formed under which, in the indicated $n_{pp}$ and $n_v$ relation, the rotating, open loop 48 will delay in its rotation in relation to the spindle 13*a*. This status can be brought about in any case when the limit ring is not connected movably with the balloon limiter, as shown by FIG. 7, 15 and 17.

The guide edge 95*d* according to FIG. 10 allows on the one hand the guiding of the yarn P during its coiling onto the tube 23*d* and, on the other hand, also in the $n_{pp}\geqq n_v$ relation, the forming of a rotating, open loop 48 that delays in its rotation in relation to the spindle 13*d* during the operation. This possibility relates to the operation of the work units according to FIGS. 12 and 18.

Another variant of the twisting and coiling mechanism 3*m* is shown in FIG. 19. The funnel-shaped mouth 26*m* of the balloon limiter 14*m*, formed by the conical flange 90*m*, in this case goes over into a limit ring 28*m* whose limit wall 29*m*, by which a direction-indicating cavity 42*m* is delimited, comprises with the inner wall of the conical flange 90*m* an obtuse angle, in such a way that the limit wall 29*m* is situated diverging in relation to the axis 17 of the spindle 13*m*. The arrangement and bearing of the guide ring 94*m* with the guide edge 95*m* concurs with the form of execution according to FIG. 12, in such a way that the corresponding parts in FIG. 19 are marked with the same reference numbers as the index m.

The guide edge 95*m* of the guide ring 94*m* is arranged inside the limit ring 28*m* before a not illustrated plane running through the exit end 46*m*—with respect to the direction of movement of the yarn P through the balloon limiter 14*m*—before a not illustrated plane running through the exit end between the exit end 46*m* and the spindle 13*a*. For the twisting and coiling device 3*m*, the A>B, C, D relation applies.

The yarn P fed over the work surface 44*m* stretches from the peripheral stop 47*m* into the rotating, open loop 48 that is formed by the inner wall of the conical flange 90*m* and the limit wall 29*m* of the limit ring 28*m*. The rear bough of the rotating, open loop 48 directed from the work surface 44*m* onto the tube 23*m*, continuously lowers during stretching of the rotating, open loop 48 until it touches the guide edge 95*m* of the guide ring 94*m*. This results in the braking of this rear bough at the guide edge 95*m* and the coiling of a corresponding section of the yarn P onto the tube 23*m*. By shortening the rotating, open loop 48, its rear bough comes into a higher position, thereby interrupting the yarn coiling. Similar to other forms of execution, this process of stretching and shortening of the rotating, open loop 48 is continuously repeated.

The spinning system can operate at various rotational speeds. It proves advantageous when the rotations of the balloon limiter 14*m* are somewhat faster than those of the spindle 13*m*, but they may eventually also be equal or moderately slower. The rotations of the rotating, open loop 48 are always slower than those of the spindle 13*m*, however. That means that the rotating, open loop 48 delays in its rotation in relation to the spindle.

FIGS. 20 and 21 show a variant of the twisting and coiling mechanism 3*n* with the balloon limiter 14*n*, which is embodied by a hollow rotation body 52*n* whose work surface 44*n* widens conically from the entry end 45*n*, which also forms the peripheral stop 47*n* of the work surface 44*n*. The exit end 26*n* of the work surface 44*n* of the balloon limiter 14*n* reaches into the limit ring 28*n*, which is formed in a body 99*n* attached by means not illustrated on a stationary ring rail 92*n* with concentric opening 93*n*.

The limit wall 29n of the limit ring 28*n* goes on the one hand over the functional recess 100*n* into the upper radial side wall 101*n* of the limit ring 28*n* and, on the other hand, over the functional gap 102*n* into the guide ring's 94*n* guide edge 95*n* embodied by the lower radial side wall. This guide edge 94*n* is situated, with respect to the direction of movement of the yarn P through the balloon limiter 14*n*, behind a not illustrated plane running through the exit end 46*n*, between the exit end 46*n* and the limit wall 29*n*.

The direction-indicating cavity 42*n* in the form of a radial gap 43*n*, into which the exit end 46*n* of the work surface 44*n* reaches, is delimited by the limit wall 29*n* and the upper radial side wall 101*n* of the limit ring 28*n* on one side and the guide edge 95*n* of the guide ring 94*n* on the other side. For the purpose of adjusting the desired height of the radial gap 43*n* that ensures the steering of the formed yarn P onto the tube 23*n*, the guide ring 94*n* is mounted axially adjustable in the body 99*n* of the limit ring 28*n*. In the example of execution of the invention, the guide ring 94*n* is screwed with its threaded outer heel 103*n* into the thread 104*n* of the inner cylindrical recess 105*n* in the body 99*n* of the limit ring 28*n*. Arranged on the periphery of the upper side wall of the outer cylindrical heel 103*n* are the cleaning openings 106*n* whose not illustrated longitudinal axes run parallel with the axis 17 of the spindle 13*n*.

The direction-indicating cavity 42*n* is connected by means of the functional gap 102*n* with the space 107*n* delimited by the upper side wall of the threaded outer heel 103*n* of the guide ring 94*n*, with the wall of the inner cylindrical recess 105*n* of the body 99*n* and with the rib-shaped closing 108*n* of the guide edge 95*n* of the guide ring 94*n*. The direction of rotation of the spindle 13*n* is marked by the arrow 41. For the construction of the twisting and coiling mechanism 3*n* the C<B, D relation applies.

The inner wall 109*n* of the guide ring 94*n* tapers conically from the guide edge 95*n*; this facilitates the spinning startup process of the spinning unit.

During the operation, the radial gap 43*n* is affected by the movement and guiding of the section of the rotating, open loop 48 due to precise guiding of the yarn P onto the tube 24*n*. The air current through the radial gap 43*n*, caused by the movement of the yarn P, is intensively attenuated by its walls. That has a positive effect on the shaping of the rotating, open loop 48, particularly in the area around its reverse bending 50. The intensity of the force between the limit wall 29*n* of the limit ring 28*n* and the yarn P situated on it is reduced. The resulting force reduction results in reduced friction for the yarn P and reduced wear of the limit wall 29*n*.

The spinning system can operate at various rotational speeds of the balloon limiter 14*n* and the spindle 13*n*. It proves most advantageous when the rotations of the balloon limiter 14*n* are somewhat faster than those of the spindle 13*n*, but they may eventually also be equal or a bit slower. The rotations of the rotating, open loop 48 are always slower than those of the spindle 13*m*, however. This means that the rotating, open loop 48 into which the yarn P stretches from the peripheral stop 47*n*, delays in its rotation in relation to the spindle 13*n*.

The continuous removal of dust and fiber remainders arising during the spinning is ensured by the cleaning openings 106*n* during operation. The impurities are removed from the radial gap 43*n* into the outside surroundings by means of the functional gap 102*n* of the space 107*n* and the cleaning openings 106*n*. For the purpose of increasing the cleaning effect, these cleaning openings can be arranged with their longitudinal axes diagonally in relation to the axis 17 of the spindle 13*n*. Consequently, there is a drop in pressure between the ends of openings, which allows the removal of a larger quantity of air and in this way a faster movement of the impurities out of the radial gap 43*n*.

The above-mentioned shows that the spinning conditions can generally be changed by selecting the rotations of the balloon limiter, the spindle, and eventually also of the limit ring and their relations to each other. The variant is advantageous when the limit ring is constructed as a static limit ring, i.e., its rotations are equal to null. The rotation relation of the balloon limiter speed and the spindle has a considerable influence on the forming of a rotating, open loop delaying or overtaking in relation to the spindle rotation. Concretely speaking, the geometric arrangement of individual components and their surface layout also come into play. It is above all a matter of the shape and diameter of the balloon limiter and the limit ring, eventually also of the guide ring. The nature of the rotating, open loop can also be influenced by the layout and height of the direction-indicating cavity, if it is used for the spinning system, and eventually also by cleaning and ventilation openings.

By the selection of speeds of the spindle, the balloon limiter and the radial distances A, B, C and D, the spinning conditions can also be formed for the production of cotton, synthetic or mixed yarns of corresponding degrees of fineness, for example. In addition, the described twisting and coiling mechanisms are also suitable for yarn twisting.

One of the possible solutions of this kind is illustrated in broken line in FIG. 1. The linear formation 110 of a feed spool 111 and the linear formation 112 of another feed spool 113 can be fed in this case by means not illustrated in the direction of the arrow 114 and 115 to the exit rollers 5 of the draft device 4 and from there into the twisting and coiling mechanism 3 for the purpose of combining together into the twisted yarn.

What is claimed is:

1. A spindle spinning or spindle twisting process, comprising:

feeding yarn from a feed device to an interior working surface of a balloon limiter such that the yarn is entrained on the interior working surface, said balloon limiter being positioned in a parallel relationship with respect to a spindle;

rotating said spindle so as to wind yarn previously entrained on the working surface of said balloon limiter on a tube supported by said spindle;

arranging said balloon limiter with respect to said spindle such that an open, rotating loop of yarn material is formed in the yarn following a departure of the yarn from the working surface of the balloon limiter and prior to the yarn coming in engagement with the spinning tube, which open, rotating loop stretches, due to centrifugal force, from a point of yarn contact on the working surface out away from said balloon limiter, and said open, rotating loop has a first loop bend section, a downstream loop bend section and an intermediate reverse bending point, which reverse bending point is at a greater radial distance from a rotational axis of said spindle than a point on said work surface from which the yarn stretches into the rotating, open loop, and the downstream bend section of said open, rotating loop has a downstream end in contact with the tube supported by said spindle, and said downstream bend section of said open, rotating loop is free from contact with said balloon limiter; and wherein feeding yarn, arranging said balloon limiter such that an open, rotating loop of yarn material is formed in the yarn following a departure of the yarn from the working surface of the balloon limiter and prior to the yarn coming in engagement with the spinning tube, and rotating said spindle imparts a spinning or twisting in the yarn being fed from the feed device.

2. Spindle spinning or spindle twisting process according to claim 1, characterized in that the rotating, open loop is radially limited during operation.

3. Spindle spinning or spindle twisting process according to claim 2, characterized in that the yarn forming the rotating, open loop is braked before coiling onto the tube.

4. Spindle spinning or spindle twisting process according to claim 1, characterized in that the yarn forming the rotating, open loop is braked before coiling onto the tube.

5. A spinning system for execution of a spindle spinning or spindle twisting process; comprising:

a feed device for feeding yarn;

a rotatable spindle for supporting a tube to receive yarn;

a drive assembly in rotation driving engagement with said spindle;

a balloon limiter arranged parallel with said spindle, anld said balloon limiter having an inner side defining a work surface for contact with the yarn formation material fed by said feed device; and said balloon limiter being dimensioned land arranged with respect to said spindle such that yarn previously entrained by the work surface of said balloon limiter travels directly off from said work surface into an open, rotating loop which has a first bend section, a downstream bend section, and an intermediate reverse bending point which reverse bending point is at a greater radial distance from a rotational axis of said spindle than a point on said work surface from which the yarn stretches into the rotating, open loop, and the downstream bend section of said open, rotating loop bas a downstream end in contact with the tube supported by said spindle, and said downstream bend section of said open, rotating loop is free from contact with said balloon limiter downstream of said reverse bend point.

6. Spinning system according to claim 5 characterized in that a peripheral stop (47 through 47*n*) represents a transition point of the yarn (P) from the work surface (44 through 44*n*) directly onto the tube (23 through 23*n*), whereby any point of the work surface (44 through 44*n*) that is situated at a greater distance from an entry end (45 through 45*n*) of the balloon limiter (14 through 14*n*) than the cited peripheral stop (47 through 47*n*) is arranged at a greater radial distance from the rotational axis (17) of the spindle (13 through 13*n*) than the peripheral stop (47 through 47*n*).

7. Spinning system according to claim 6, characterized in that the balloon limiter (14 through 14*f*, 14*h* through 14*n*) has a funnel-shaped mouth (26 through 26*f*, 26*h* through 26*n*).

8. Spinning system according to claim 6, further comprising a limit ring (28 through 28*d*, 28*g*, 28*i* through 28*n*), that is concentric with the spindle (13 through 13*d*, 13*g*, 13*i* through 13*n*) and includes a limit wall (29 through 29*d*, 29*g*, 29*i* through 29*n*) positional for radial limitation of the rotating, open loop (48), whereby a radial distance (B) of the limit wall (29 through 29*d*, 29*g*, 29*i* through 29*n*) from a rotation axis (17) of the spindle (13 through 13*d*, 13*g*, 13*i* through 13*n*) is greater than a radial distance (A) of the peripheral stop (14 through 14*d*, 14*g*, 14*i* through 14*n*) from the rotation axis (17) of the spindle (13 through 13*d*, 13*g*, 13*i* through 13*n*).

9. Spinning system according to claim 8, characterized in that the limit ring (28*b*, 28*d*, 28*g*, 28*i*, 28*k*, 28*l*, 28*n*) is non-rotating.

10. Spinning system according to claim 8, characterized in that the limit ring (28, 28*c*) has a first end extending toward a funnel-shaped mouth (26, 26*c*) of the balloon limiter (14, 14*c*) and a second end extending into a side wall (30, 30*e*) that is spaced from the funnel-shaped mouth (26, 26*c*) and has an internal edge defining an axial opening for the passage of the rube (23, 23*c*) with the spindle (13, 13*c*), whereby the limit ring (28, 28*c*), the funnel-shaped mouth (26, 26*c*) and the side wall (30, 30*c*) delimit a direction-indicating cavity (42, 42*c*) for the coiling of the yarn (P) from the rotating, open loop (48) onto the tube (23, 23*c*) of the spindle (13, 13*c*).

11. Spinning system according to claim 3, characterized in that the limit wall (29) of the limit ring (28) includes ventilation openings (49).

12. Spinning system according to claim 6, characterized in that a second balloon limiter which is a concentric, non-rotating balloon limiter (66*a*, 66*e*) is placed upstream of said balloon limiter (14*a*, 14*c*) in rotation driving engagement with said driving assembly.

13. Spinning system according to claim 6, further comprising a guide ring (94*d*, 94*f*, 94*l* through 94*n*) which is positioned concentric with the spindle (13*d*, 13*f*, 13*l* through 13*n*), and which includes a guide edge (95*d*, 95*f*, 95*l* through 95*n*) for providing guidance to yarn coiling onto the tube (23*d*, 23*f*, 23*l* through 23*n*).

14. Spinning system according to claim 13, characterized in that the guide edge (95*d*, 95*f*, 95*m*) of the guide ring (94*d*, 94*f*, 94*m*) is situated between an exit end (46*d*, 46*f*, 46*m*) of the work surface (44*d*, 44*f*, 44*m*) and the spindle (13*d*, 13*f*, 13*m*).

15. Spinning system according to claim 13, characterized in that the guide edge (95*l*, 95*n*) of the guide ring (94*l*, 94*n*) is situated between an exit end (46*l*, 46*n*) of the work surface (44*l*, 44*n*) and the limit wall (29*l*, 29*n*) of the limit ring (28*l*, 28*n*).

16. Spinning system according to claim 13, characterized in that the guide edge (95*d*, 95*l*, 95*m*) of the guide ring (94*d*, 94*l*, 94*m*) is at a height between an upper vertical extremity and lower vertical extremity of said limit ring (28*d*, 28*l*, 28*m*).

17. Spinning system according to claim 13, characterized in that the guide edge (95*n*) of the guide ring (94*n*) is mounted axially adjustable in a body (99*n*) of the limit ring (28*n*).

18. Spinning system according to claim 17, characterized in that at the periphery of the guide ring (28*n*), cleaning openings (106*n*) are provided which pneumatically connect a direction-indicating cavity (42*n*) which receives the rotating open loop with a functional gap (102*n*) formed between the limit ring (28*n*) and the guide ring (94*n*) which functional gap opens out to surrounding space.

19. A spindle spinning system for execution of a spindle spinning or spindle twisting process, comprising:

a spindle;

means for spinning the spindle;

a balloon limiter:

means for feeding yarn to an interior working surface of said balloon limiter such that the yarn is entrained on the interior working surface, said balloon limiter being positioned in a parallel relationship with respect to said spindle; and said spindle spinning system including means for forming an open, rotating loop of yarn following an initial departure of the yarn from the working surface of the balloon limiter and prior to the yarn coming in engagement with a spinning tube supported by said spindle, which open loop stretches from a point of yarn contact on the working surface out away from said balloon limiter, and said open rotating loop has a first loop bend section, a downstream loop bend section and an intermediate reverse bending point, which reverse bending point is at a greater radial distance from a rotational axis of said spindle than a point on said work surface from which the yarn stretches into the rotating, open loop, and said open, rotating loop has a downstream end in contact with the spinning tube supported by said spindle, and said open, rotating loop is free from contact with said balloon limiter downstream from said initial departure of the yarn from the working surface.

20. A spindle spinning or spindle twisting process, comprising:

feeding yarn from a feed device to an interior working surface of a balloon limiter such that the yarn is entrained on the interior working surface, said balloon limiter being positioned in a parallel relationship with respect to a spindle;

rotating said spindle so as to wind yarn previously entrained on the working surface of said balloon limiter on a tube supported by said spindle;

forming an open, rotating loop of yarn material which is formed in the yarn following an initial departure of the yarn from the working surface of the balloon limiter and prior to the yarn coming in engagement with the spinning tube, which open, rotating loop stretches, due to centrifugal force, from a point of yarn contact on the working surface out away from said balloon limiter, and said open rotating loop has a first loop bend section, a downstream loop bend section and an intermediate reverse bending point, which reverse bending point is at a greater radial distance from a rotational axis of said spindle than a point on said work surface from which the yarn stretches into the rotating, open loop, and said open, rotating loop is free from contact with said balloon limiter downstream from said initial departure of the yarn from the working surface, and wherein feeding yarn and rotating said spindle receiving the yarn after being entrained on the working surface and following formation of the rotating loop of yarn imparts a spinning or twisting in the yarn being fed from the feed device.

21. A spindle system comprising:

a yarn feed device;

a twisting and coiling mechanism which receives yarn from said yarn feed device, said twisting and coiling mechanism including:

a) a spindle and means for rotating said spindle, and b) a balloon limiter which is positioned in a concentric relationship respect to said spindle, said balloon limiter having an interior working surface which entrains the yarn received from said yarn feed device; and said spindle system including a direction indicating cavity which direction indicating cavity is for receiving a rotating, open loop of yarn formation material, the direction indicating cavity being defined by an outwardly extending flange section of said balloon limiter and a limit ring having an interior contact surface positioned for contact with a bend point of said rotating, open loop wherein the bend point rotates within said cavity in contact with the interior contact surface of said limit ring and is intermediate an upstream bend section of said rotating, open loop and a downstream bend section of said rotating, open loop, and said downstream bend section extends only inwardly from said reverse bend point from said direction indicating cavity into a coiling arrangement with respect to a tube supported by said rotating spindle.

22. A spindle system as recited in claim 21 wherein said limiting ring is defined by a concave shaped extension that is integral with said outwardly extending flange section, and said direction indicating cavity being further defined by a bottom flange which extends inwardly from said concave shaped extension toward said spindle.

23. A spindle system as recited in claim 21 wherein said limiting ring is an independent member with respect to said balloon limiter.

24. A spindle system as recited in claim 23 further comprising limiting ring rotation means for rotating said limiting ring independent of said balloon limiter.

25. A spindle as recited in claim 23 wherein said limiting ring is fixed in position within said system with respect to the rotating balloon limiter.

26. A spindle system as recited in claim 21 wherein said direction indicating cavity is defined by a lower horizontal wall of said limiting ring and an upper horizontal wall defined by an outwardly expanding flange of said balloon limiter.

27. A spindle system as recited in claim 21 further comprising braking and guiding means positioned for frictional contact with said rotating, open loop while said open, rotating loop rotates in said direction indicating cavity.

28. A spinning method, comprising:

feeding yarn from a yarn feed device to an interior working surface of a balloon limiter positioned in a concentric relationship with respect to an internal spindle;

rotating the spindle;

coiling yarn on a tube supported by said spindle;

forming a rotating, open loop of yarn material at a lower end of said balloon limiter and directing said rotating, open loop of yarn material into a direction indicating cavity defined by an outwardly extending flange section of said balloon limiter and a limit ring having an interior contact surface positioned for contact with a reverse bend point of said rotating, open loop, which bend point rotates within said cavity in contact with the interior contact surface of said limiting ring and is intermediate an upstream bend section of said rotating, open loop and a downstream bend section of said rotating, open loop, and said yarn is maintained internally both with respect to the working surface of said balloon limiter and the contact surface of said limiting ring at all times of travel of the yarn within the balloon limiter and limiting ring, and said downstream bend section extends directly from the reverse bend section internally into coiling contact with the tube, and wherein feeding yarn to the interior surface of the balloon limiter and rotating said spindle receiving the yarn after formation of the rotating loop of yarn imparts a spinning or twisting in the yarn being fed from the feed device.

29. The method as recited in claim 28 wherein said limiting ring is independent of said balloon limiter and said balloon limiter is rotated at a different speed than said limiting ring during the coiling of yarn formation material on the tube.

30. The method as recited in claim 29 further comprising maintaining said limiting ring stationary.

31. The method as recited in claim 28 further comprising guiding and braking said rotating open loop, during the coiling of yarn formation material on the tube, by placement of an upper edge of a guiding and braking member in contact with a portion of the rotating open loop positioned between the reverse bend and a point of coiling engagement with the tube.

32. The method as recited in claim 31 further comprising adjusting a position of the upper edge of said braking method during the coiling of yarn formation material on the tube to alter the guidance braking characteristics imposed on said rotating, open loop.

* * * * *